US012648642B2

(12) United States Patent
Jenkins et al.

(10) Patent No.: US 12,648,642 B2
(45) Date of Patent: Jun. 9, 2026

(54) STORAGE SYSTEM

(71) Applicant: TECHTRONIC CORDLESS GP, Anderson, SC (US)

(72) Inventors: J. Luke Jenkins, Williamston, SC (US); Jeffrey Groves, Greenville, SC (US); Tyler H. Knight, Greenville, SC (US); Stephen A. Hughett, Anderson, SC (US)

(73) Assignee: TECHTRONIC CORDLESS GP, Anderson, SC (US)

( * ) Notice: Subject to any disclaimer, the term of this patent is extended or adjusted under 35 U.S.C. 154(b) by 661 days.

(21) Appl. No.: 17/505,345

(22) Filed: Oct. 19, 2021

(65) Prior Publication Data

US 2022/0117393 A1 Apr. 21, 2022

Related U.S. Application Data

(60) Provisional application No. 63/143,478, filed on Jan. 29, 2021, provisional application No. 63/094,134, filed on Oct. 20, 2020.

(51) Int. Cl.
*A47B 81/00* (2006.01)
*A47B 96/14* (2006.01)

(52) U.S. Cl.
CPC ..... *A47B 96/1408* (2013.01); *A47B 81/00* (2013.01)

(58) Field of Classification Search
CPC ..... A47B 96/1408; A47B 81/00; B25H 3/04; B25H 3/021
See application file for complete search history.

(56) References Cited

U.S. PATENT DOCUMENTS 2,541,828 A 2/1951 Peck
2,695,105 A 11/1954 Mitchell
2,991,040 A * 7/1961 Levy ..... A47F 5/08 211/105.6
3,148,638 A * 9/1964 Shelor ..... A47B 96/04 108/108
3,184,068 A * 5/1965 Wende ..... A47F 7/04 211/23
3,200,961 A * 8/1965 Kolster ..... B42F 17/08 211/186

(Continued)

FOREIGN PATENT DOCUMENTS

AU 2015101015 B4 9/2015
EP 2772155 A1 * 9/2014 ..... A47B 45/00

(Continued)

OTHER PUBLICATIONS

Extended European Search Report for Application No. 21203797.2 dated Feb. 24, 2022 (11 pages).

*Primary Examiner* — Stanton L Krycinski
(74) *Attorney, Agent, or Firm* — Dority & Manning, P.A.

(57) ABSTRACT

A storage assembly includes a first upright member configured to be supported by a surface, a second upright member configured to be supported by the surface, and a mount selectively supported by at least one of the first upright member and the second upright member. The second upright member is oriented parallel to and is spaced apart from the first upright member. The mount is configured to support an accessory and includes a mating interface having at least one feature that is complementary to a feature positioned on the accessory.

7 Claims, 26 Drawing Sheets

(56) References Cited

U.S. PATENT DOCUMENTS 3,221,678 A * 12/1965 Doherty ..... A47B 57/26 108/106
3,221,894 A * 12/1965 Knuth ..... A47B 57/30 211/187
3,297,374 A * 1/1967 Radek ..... A47F 5/103 312/334.47
3,305,286 A * 2/1967 Fenwick ..... A47F 5/103 211/187
3,323,851 A * 6/1967 Duboff ..... A47B 96/1425 312/247
3,329,282 A * 7/1967 Swan ..... A47F 5/14 211/190
3,396,840 A * 8/1968 Farren ..... B65G 1/08 211/175
3,492,772 A * 2/1970 Bergman ..... A47F 7/24 52/459
3,504,405 A 4/1970 Cecily
3,557,966 A * 1/1971 Skubic ..... A47B 81/007 211/24
3,655,159 A * 4/1972 Held, Jr. ..... A47F 5/103 211/187
3,711,053 A * 1/1973 Drake ..... H05K 7/16 248/298.1
3,730,108 A * 5/1973 Stroh ..... A47F 5/103 108/189
3,771,466 A * 11/1973 Ferdinand ..... A47B 57/42 248/200.1
3,908,830 A * 9/1975 Skrzelowski ..... A47F 5/08 248/205.2
3,921,539 A * 11/1975 Berger ..... A47F 5/12 108/106
3,971,477 A * 7/1976 Bruderly ..... A47F 5/103 52/264
4,018,340 A * 4/1977 Gold ..... A47F 7/175 211/44
4,046,083 A * 9/1977 Murdoch ..... A47F 5/103 108/193
4,093,078 A * 6/1978 Radek ..... A47F 5/103 211/189
4,119,285 A 10/1978 Bisping et al.
5,027,570 A * 7/1991 Mitchell ..... B62D 33/04 296/203.03
5,027,962 A * 7/1991 Maccarrone ..... A47B 57/04 211/182
5,236,095 A * 8/1993 Krizka ..... A47B 47/00 211/96
5,305,898 A * 4/1994 Merl ..... A47F 5/0807 248/220.42
5,359,752 A 11/1994 Domenig
D358,623 S * 5/1995 Macasieb ..... A63B 21/078 D21/691
5,443,167 A * 8/1995 Menaged ..... A47F 5/0823 211/106.01
5,472,103 A * 12/1995 Merl ..... A47B 47/022 211/187
5,477,971 A * 12/1995 Howard ..... A47F 5/101 211/187
5,495,952 A * 3/1996 Kainz ..... A47F 5/105 52/36.6
5,503,277 A 4/1996 O'Brien
5,509,541 A * 4/1996 Merl ..... A47B 57/42 211/208
5,529,192 A * 6/1996 Conen ..... A47B 96/028 211/187
5,566,844 A * 10/1996 Bernardin ..... A47F 5/0846 211/208
5,601,196 A 2/1997 Heer et al.
5,605,238 A * 2/1997 Jacobs ..... A47B 57/54 211/187
5,607,070 A * 3/1997 Hellyer ..... A47F 5/0846 211/187
5,641,081 A * 6/1997 Merl ..... A47F 5/08 211/106
5,660,286 A * 8/1997 Shea ..... A47F 5/083 211/189
5,669,515 A 9/1997 Tisbo et al.
5,769,247 A * 6/1998 Merl ..... A47B 47/022 211/88.01
5,799,915 A 9/1998 Morey
5,803,273 A * 9/1998 Menaged ..... A47F 5/0823 211/105.3
5,848,711 A * 12/1998 Schmit ..... A47B 96/00 312/246
5,857,577 A * 1/1999 Thomas ..... A47B 96/061 211/94.01
5,918,750 A * 7/1999 Jackson ..... A47F 5/0807 108/108
5,921,190 A * 7/1999 Wood ..... A47F 5/103 108/106
5,921,411 A * 7/1999 Merl ..... A47B 96/027 211/94.01
6,021,613 A * 2/2000 Reuter ..... E04B 2/7425 52/241
6,029,833 A * 2/2000 Yeh ..... A47F 7/19 211/187
6,044,986 A * 4/2000 Wood ..... A47F 5/103 211/90.04
6,062,401 A * 5/2000 Hall ..... A47B 87/0246 211/186
6,115,978 A * 9/2000 Bastian ..... E04B 2/7455 52/36.5
6,138,583 A * 10/2000 Mahone ..... A47B 57/42 211/187
6,164,467 A * 12/2000 DePottey ..... A47F 5/0846 52/36.5
6,193,083 B1 * 2/2001 Wood ..... G09F 15/00 211/90.04
6,427,855 B2 * 8/2002 LaBruna, Jr. ..... A47F 7/24 211/187
6,499,608 B1 12/2002 Sterling et al.
6,520,355 B1 * 2/2003 Pritchard ..... A47B 96/04 211/187
6,564,949 B1 5/2003 Saathoff
6,564,952 B1 * 5/2003 Suttles ..... A47F 5/01 211/187
6,659,295 B1 * 12/2003 De Land ..... A47B 96/04 211/187
6,918,499 B2 * 7/2005 De Land ..... A47F 5/0018 211/187
7,270,242 B2 * 9/2007 Liu ..... A47B 47/024 248/188.8
7,338,110 B1 * 3/2008 Eckloff ..... B60R 11/00 296/3
7,469,512 B2 * 12/2008 Faber ..... E04B 2/7453 52/220.2
7,494,019 B2 * 2/2009 Kessell ..... A47B 57/06 211/186
7,591,385 B2 * 9/2009 Brooks ..... B25H 3/04 211/94.01
7,641,253 B2 * 1/2010 Steiger ..... B60P 3/14 296/24.4
7,775,379 B2 * 8/2010 Hodge ..... A47F 7/144 100/61
7,784,885 B2 * 8/2010 Steiger ..... B60R 11/00 108/106
7,810,658 B2 * 10/2010 Clark ..... A47F 5/137 211/189
8,028,846 B2 * 10/2011 Peota ..... F16B 12/50 211/187
8,157,312 B2 * 4/2012 Bliss, Jr. ..... B60P 3/14 224/403
8,191,845 B1 6/2012 Yu
8,720,704 B2 * 5/2014 Gupta ..... A47B 96/025 211/74
8,746,470 B2 * 6/2014 Reinbigler ..... A47B 91/002 211/126.15

(56) References Cited

U.S. PATENT DOCUMENTS 8,807,356 B2 * 8/2014 Weigand ..... A47F 5/10 211/183
8,919,579 B2 * 12/2014 Weigand ..... A47F 7/144 211/186
8,959,813 B2 * 2/2015 Denby ..... G09F 15/0068 40/606.03
8,985,352 B2 * 3/2015 Bergdoll ..... A47B 57/16 211/59.3
9,119,487 B2 * 9/2015 Angvall ..... G09F 7/18
9,132,543 B2 * 9/2015 Bar-Erez ..... B62B 1/04
9,146,001 B2 * 9/2015 Stifal ..... F16M 11/045
9,206,827 B2 12/2015 Loree et al.
9,215,924 B2 * 12/2015 Seefeldt ..... A47B 21/06
9,333,387 B2 * 5/2016 Hopperstad ..... A63B 21/00047
9,642,456 B2 * 5/2017 Cooper ..... A47B 57/10
9,770,122 B2 * 9/2017 Gonzalez ..... A47B 95/008
9,918,568 B1 * 3/2018 Blake ..... A47G 25/0678
9,936,825 B1 * 4/2018 Lindblom ..... A47F 5/0087
10,021,996 B2 * 7/2018 Cantwell ..... A47F 5/0807
10,037,659 B2 * 7/2018 Wise ..... G07G 1/0018
10,092,098 B2 * 10/2018 Jackson ..... F16M 13/02
10,226,661 B2 * 3/2019 Henniger ..... A63B 21/4035
10,226,862 B2 * 3/2019 Blake ..... A47F 5/0807
10,306,981 B2 * 6/2019 Buck ..... A47F 5/0025
10,703,534 B2 7/2020 Brunner et al.
10,799,041 B1 * 10/2020 Lawson ..... A47F 5/103
10,953,301 B2 * 3/2021 Brasch ..... A63B 1/00
11,006,749 B2 5/2021 Anderson et al.
12,053,084 B2 * 8/2024 Nilsson ..... A47B 57/42
2005/0150850 A1 7/2005 Stitchick et al.
2005/0269276 A1 12/2005 Pfeiffer
2006/0016774 A1 * 1/2006 Bustos ..... A47B 96/1466 211/186
2007/0125731 A1 6/2007 Waterman
2008/0000853 A1 1/2008 Huang
2008/0006592 A1 1/2008 Brooks
2008/0054142 A1 3/2008 Deland
2009/0145866 A1 6/2009 Panosian et al.
2011/0062295 A1 3/2011 Totman
2011/0234072 A1 9/2011 Hightower
2012/0012726 A1 1/2012 Daniels
2013/0047386 A1 2/2013 Barfoot et al.
2014/0149242 A1 * 5/2014 Turner, Jr. ..... A47B 91/00 211/186
2014/0263119 A1 9/2014 Gruger et al.
2017/0166103 A1 * 6/2017 Eichstedt ..... B60P 3/007
2017/0217358 A1 * 8/2017 Paunov ..... B60R 5/003
2017/0274522 A1 9/2017 Kao
2018/0178051 A1 * 6/2018 Shaw, Jr. ..... A63B 21/078
2018/0295983 A1 10/2018 Robinson et al.
2019/0126088 A1 * 5/2019 Henniger ..... A63B 23/1218
2019/0247995 A1 8/2019 Hocine et al.
2020/0323340 A1 10/2020 Nilsson et al.
2022/0016466 A1 * 1/2022 Henniger ..... A63B 23/1218
2022/0040842 A1 * 2/2022 Groves ..... F16M 13/02

FOREIGN PATENT DOCUMENTS

EP 3569108 A1 * 11/2019 ..... A47B 57/10
KR 101393676 B1 * 5/2014

* cited by examiner

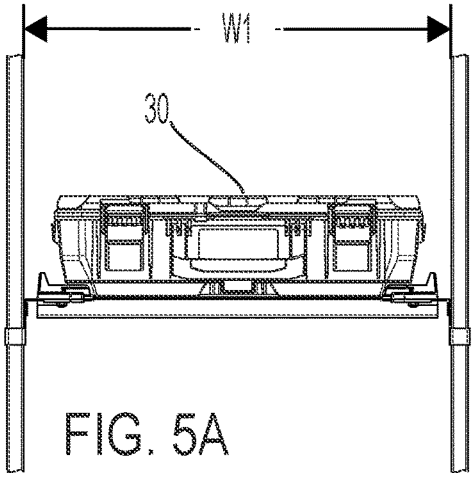
FIG. 5A
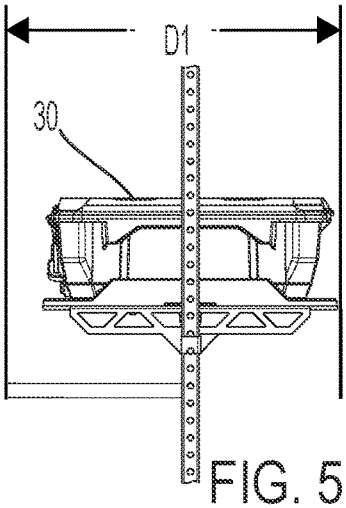
FIG. 5B
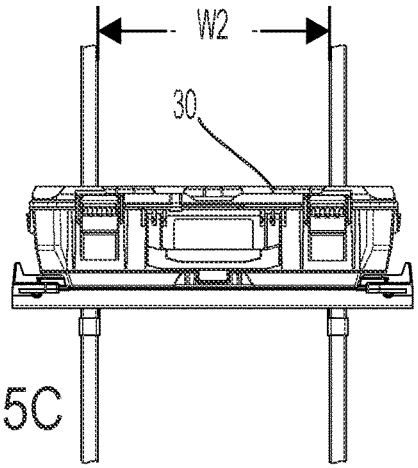
FIG. 5C
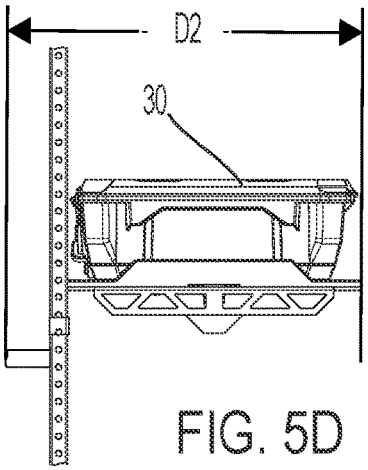
FIG. 5D
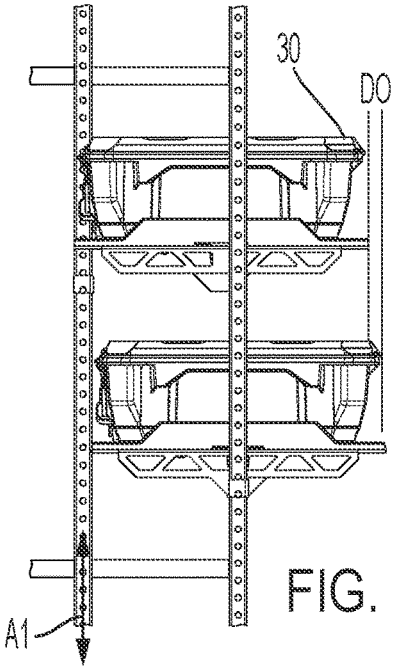
FIG. 5E
FIG. 5F
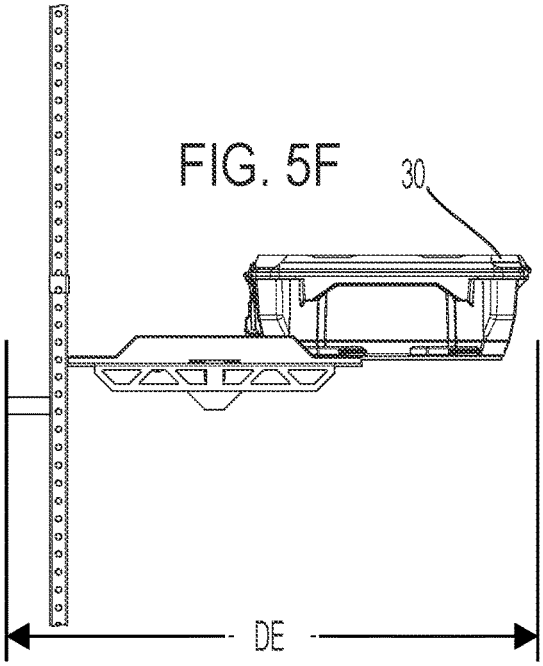

STORAGE SYSTEM

CROSS-REFERENCE TO RELATED APPLICATIONS

This application claims priority to U.S. Provisional Patent Application No. 63/094,134, filed Oct. 20, 2020, and U.S. Provisional Patent Application No. 63/143,478, filed Jan. 29, 2021, the entire contents of which are incorporated herein by reference.

BACKGROUND

The present disclosure relates to storage systems. More particularly, the present disclosure relates to structures that support storage containers for tools, accessories, and the like.

SUMMARY

In one independent aspect, a storage system includes: a first upright member configured to be supported by a surface; a second upright member configured to be supported by the surface, the second upright member oriented parallel to and spaced apart from the first upright member; and a mount selectively supported by at least one of the first upright member and the second upright member, the mount configured to support an accessory, the mount including a mating interface having at least one feature that is complementary to a feature positioned on the accessory.

In another independent aspect, a storage system includes: a plurality of support members, the support members oriented parallel to one another and laterally spaced apart from one another; a wall rail coupled to a support surface; a plurality of mounting brackets supported on the wall rail, each mounting bracket coupled to the wall rail and supporting an associated one of the support members; and an arm supported by at least one of the support members and configured to receive at least one accessory, the arm being selectively and removably securable to the at least one support member at a plurality of positions.

In yet another independent aspect, a storage system includes: a first upright member configured to be supported relative to a surface; a second upright member configured to be supported relative to the surface, the second upright member oriented parallel to the first upright member; a third upright member oriented parallel to and positioned between the first upright member and the second upright member; a first mount selectively supported by at least one of the first upright member and the second upright member, the mount configured to support an accessory; and a second mount selectively coupled to the third upright member in a first orientation in which the second mount faces toward the first upright member and a second orientation in which the second mount faces toward the second upright member.

Other aspects of the disclosure will become apparent by consideration of the detailed description and accompanying drawings.

BRIEF DESCRIPTION OF THE DRAWINGS

FIGS. 5A-5F illustrate side views of the storage system of FIG. 1 and the storage system of FIG. 4 supported on a frame.

Before any aspects are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

The use of "including," "comprising," or "having," and variations thereof herein is meant to encompass the items listed thereafter and equivalents thereof as well as additional items. Unless specified or limited otherwise, the terms "mounted," "connected," "supported," and "coupled," and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
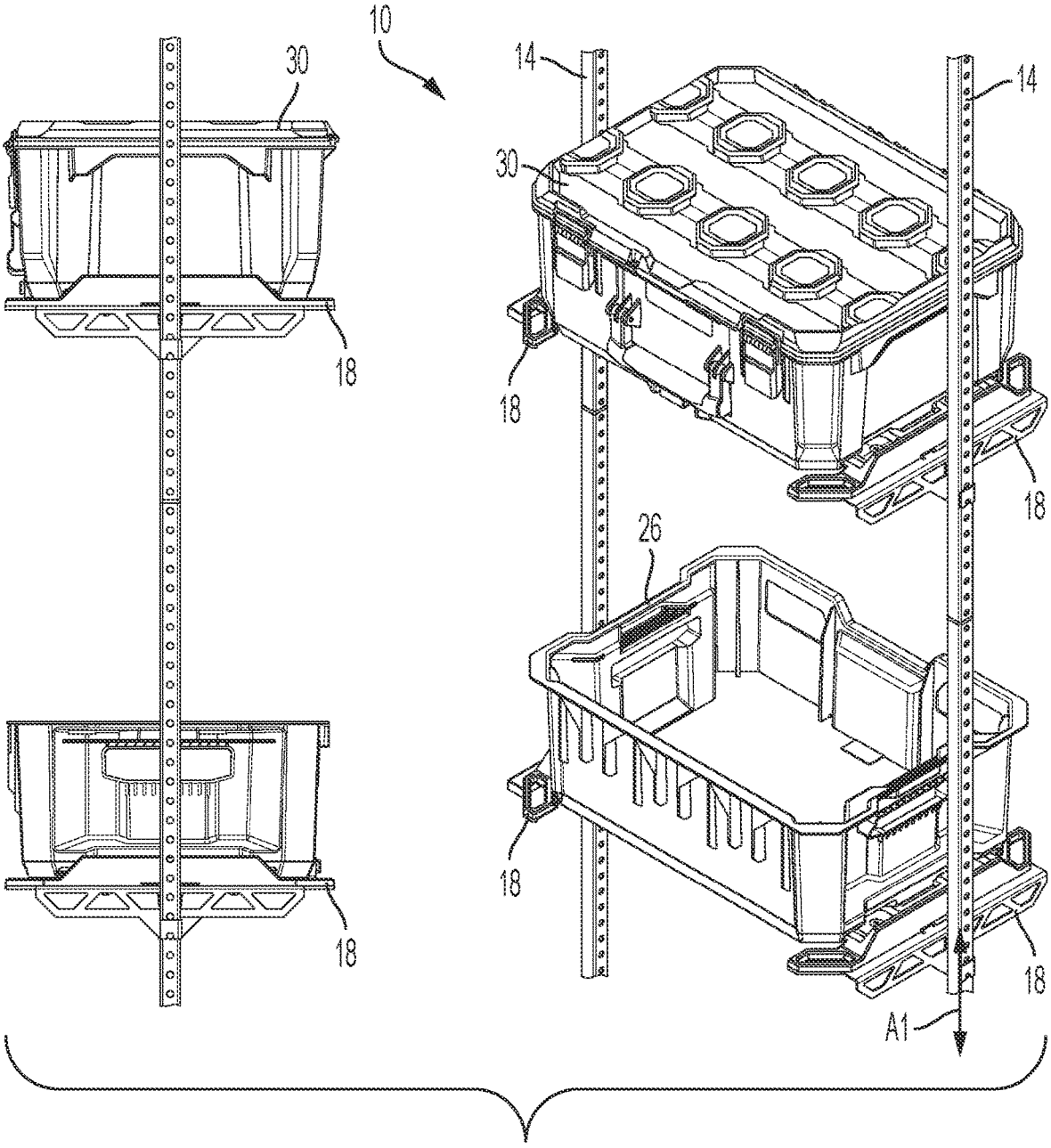
FIG. 1 is a perspective view of a storage system, according to one embodiment.
Figure 2:
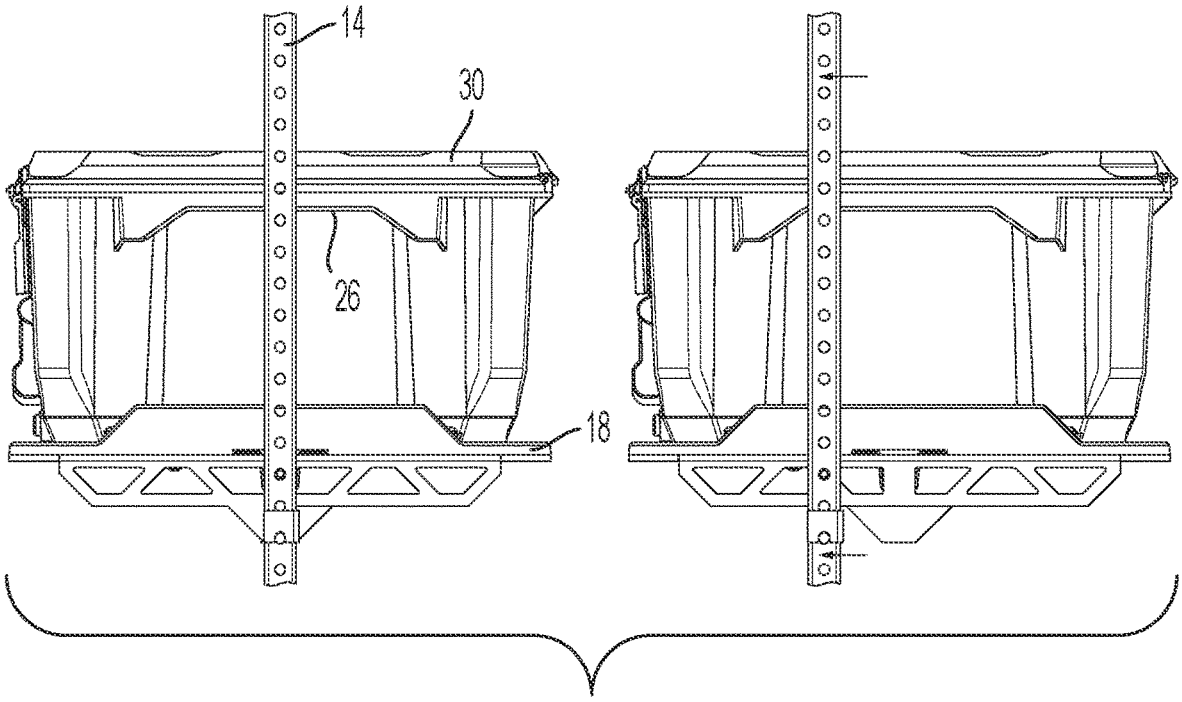
FIG. 2 is a side view of the storage system of FIG. 1.
Figure 3A:
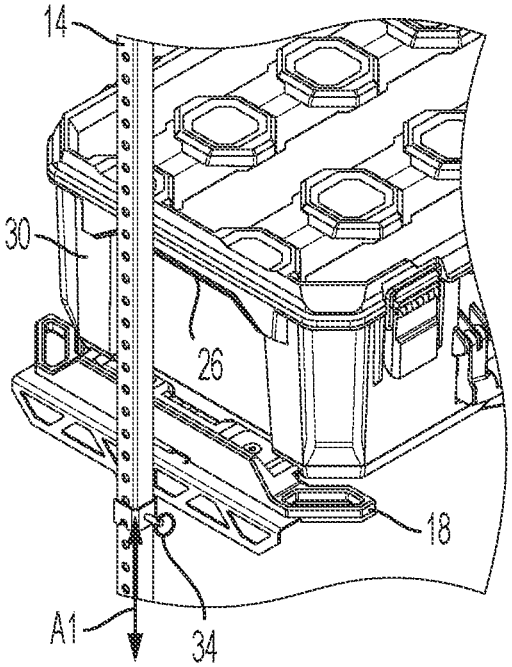
FIG. 3A is a perspective view of a portion of the storage system of FIG. 1.

As shown in FIGS. 1-3, a storage assembly or system 10 includes upright supports 14 and arms 18 coupled to the upright supports 14. In the illustrated embodiment, the storage system 10 includes a pair of upright supports 14 that are supported on a support surface (e.g., a vertical wall and/or a horizontal floor of a structure, room, garage, vehicle, and/or or the like) and laterally spaced apart from one another. The arms 18 may be arranged in pairs, and an arm 18 coupled to one of the upright supports 14 may be oriented parallel to and spaced laterally apart from an associated arm 18 coupled to the other upright support 14. Each pair of arms 18 cooperates to provide a support surface or mount for an accessory, such as a storage container 30, a toolbox, a crate, a case, a bin, and/or the like. The storage container 30 and arm 18 may each include complementary features that provide a common mating interface, as described and illustrated below. As illustrated in FIGS. 1, 3A, 4, 5E, 6C, 7, 11, 13, 19, and 21, the upright supports 14 may define a first upright axis A1 (e.g., vertical direction). As illustrated in FIGS. 7, 13, 19, and 21, two upright supports 14 may be offset in a direction that defines a second flat axis A2 (e.g., horizontal direction). The first axis A1 and the second axis A2 may be generally perpendicular relative one another. The storage assemblies or systems 10 defined herein may be configurable in various ways.

In the illustrated embodiment, the arms 18 are positioned between the upright supports 14, and the storage container 30 is positioned between the upright supports 14 while supported on the arms 18. The upright supports 14 are substantially centered along the side of the storage container 30 (e.g., with respect to a front-to-rear direction), while allowing space to permit a user's hand to grasp handles 26 positioned on the sides of the container 30. In some embodiments, the upright supports 14 may be oriented off-center in the front-to-rear direction in order to provide additional space for a user to grasp the handles 26. In the illustrated embodiment, the centered supports 14 may provide even and/or balanced load for increased capacity options for the container 30. In some embodiments, the supports 14 may be formed of a polygonal (e.g., square) tube or beam.

Figure 3B:
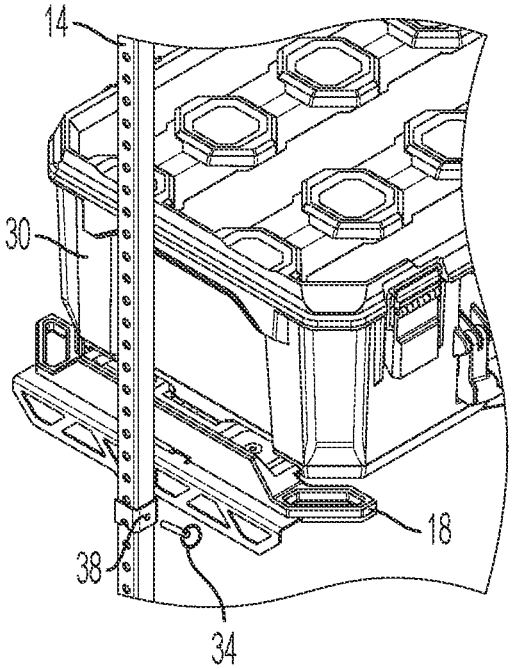
FIG. 3B is a perspective view of FIG. 3A, illustrating a pin removed from the storage system.

As shown in FIGS. 3A and 3B, in some embodiments the arms 18 are releasably/removably coupled to the upright supports 14 to facilitate adjusting the position of the arms 18 along the upright supports 14. For example, each arm 18 may be coupled to the associated upright support 14 by a retainer (e.g., a clip or a pin 34 extending through the arm 18 and extending through an opening 38 in the upright support 14).

Figure 4:
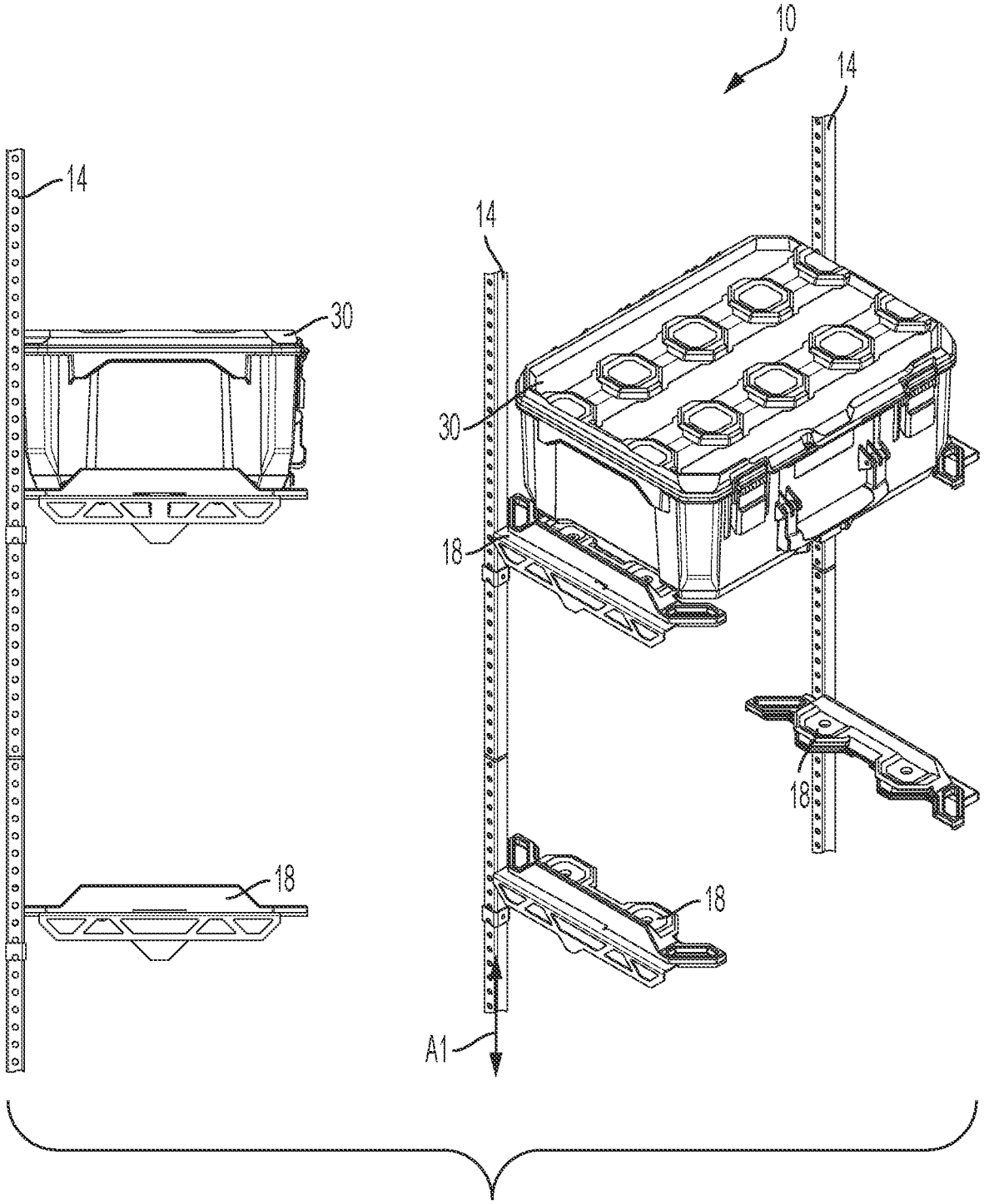
FIG. 4 is a perspective view of a storage system, according to another embodiment.

FIG. 4 illustrates another embodiment of the storage system 10 in which each arm 18 can be removably coupled to the associated upright support at an end of the arm 18. Stated another way, the arms 18 are supported on the upright support 14 in a cantilevered manner, permitting the upright supports 14 to be positioned adjacent the support surface or wall and providing a narrower overall width between the sides of the storage system 10.

FIGS. 5A-5F illustrate some differences between the cantilevered support embodiment of FIG. 4 and the non-cantilevered or centered support embodiment of FIGS. 1-3. FIG. 5A illustrates a width W1 of the supports 14 in the non-cantilevered arrangement, while FIG. 5B illustrates a distance or depth D1 of the supports 14 relative to the wall. In some embodiments, the width W1 of the supports 14 in the non-cantilevered arrangement is approximately 24 inches and the depth D1 is approximately 17 inches. In other embodiments, other dimensions of depth, width, offset, and/or the like based on a desired application/use are contemplated.

FIG. 5C illustrates a width W2 of the supports 14 in the cantilevered arrangement, while FIG. 5D illustrates a distance or depth D2 of the supports 14 relative to the wall. In some embodiments, the width W2 of the supports 14 in the cantilevered arrangement is approximately 22 inches and the depth D2 is approximately 18.5 inches. In other embodiments, other dimensions of depth, width, offset, and/or the like based on a desired application/use are contemplated.

FIG. 5E illustrates an offset depth DO between the supports 14 in the non-cantilevered arrangement and the supports 14 in the cantilevered arrangement. In the illustrated embodiment, the offset depth DO is approximately 1.5 inches. In other embodiments, other dimensions of depth, width, offset, and/or the like based on a desired application/use are contemplated.

FIG. 5F illustrates an extendable depth DE of the container 30 in the cantilevered arrangement. In the illustrated embodiment, the extendable depth DE is approximately 29.5 inches. In other embodiments, other dimensions of depth, width, offset, and/or the like based on a desired application/use are contemplated.

In some embodiments the storage container 30 may be positioned/removable couplable in a first region (FIG. 5B) of the storage system 10, a second region (FIG. 5D) of the storage system 10, and/or a third region (FIG. 5F) of the storage system 10, in which the different regions generally relate to a depth of the container 30. In some embodiments, the regions correspond to different side-to-side positions and/or orientations.

Figure 6A:
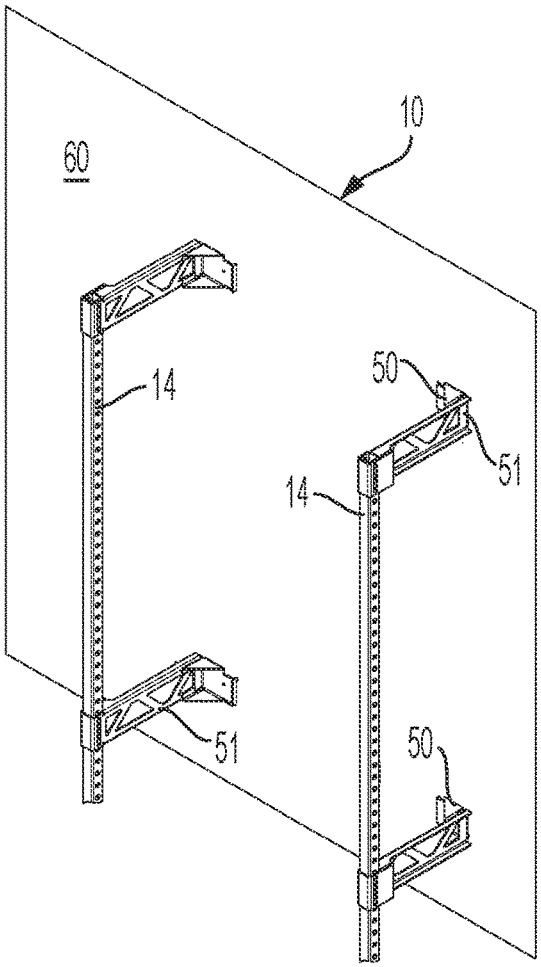
FIGS. 6A-6C are perspective views of a storage system, according to another embodiment.
Figure 6B:
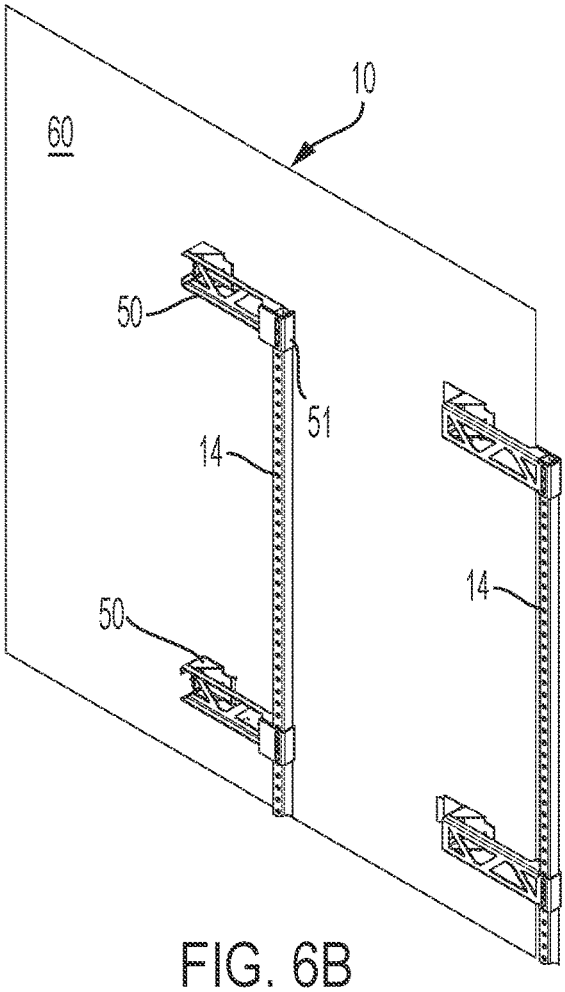
Figure 6C:
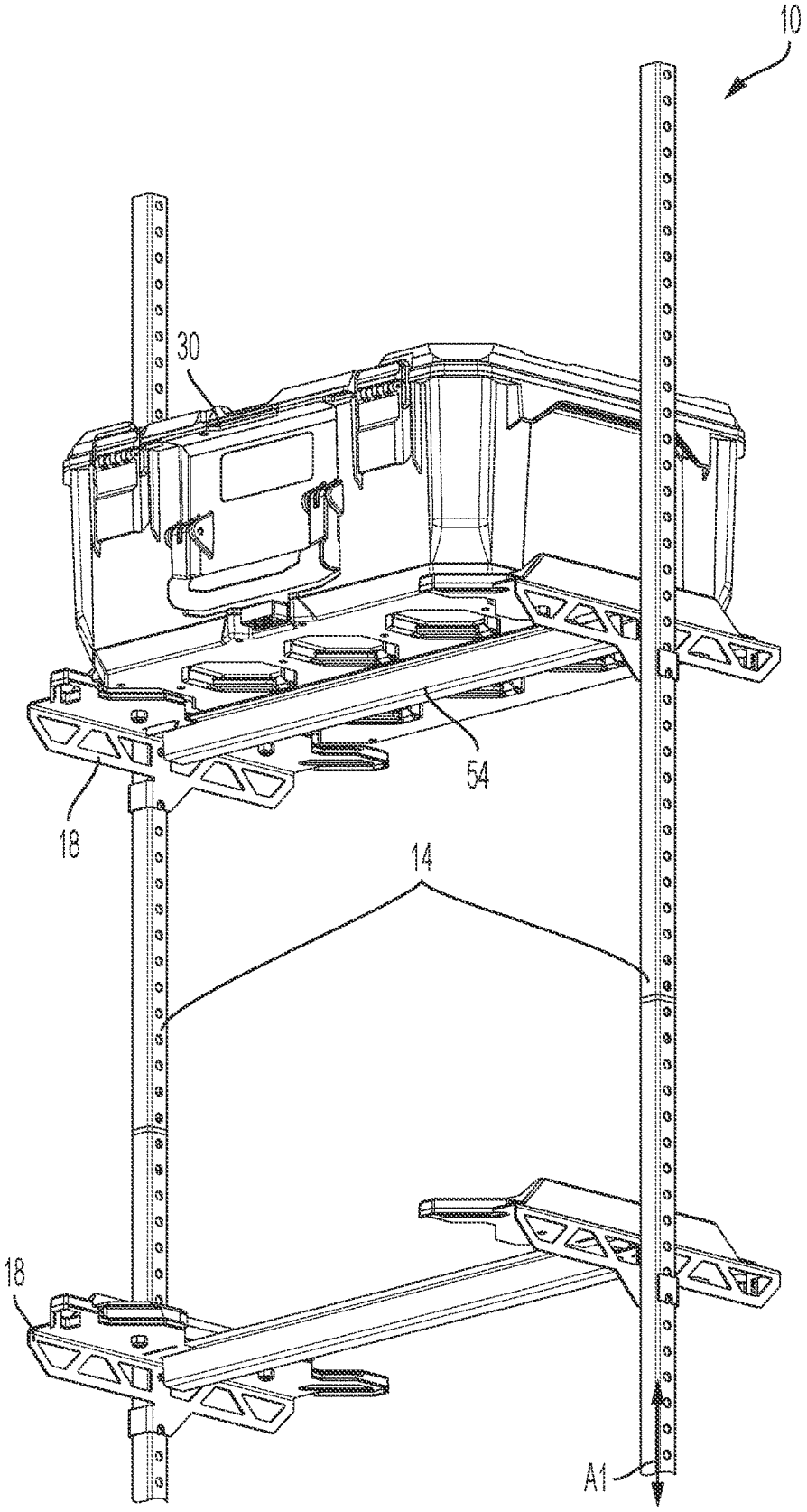
Figure 7:
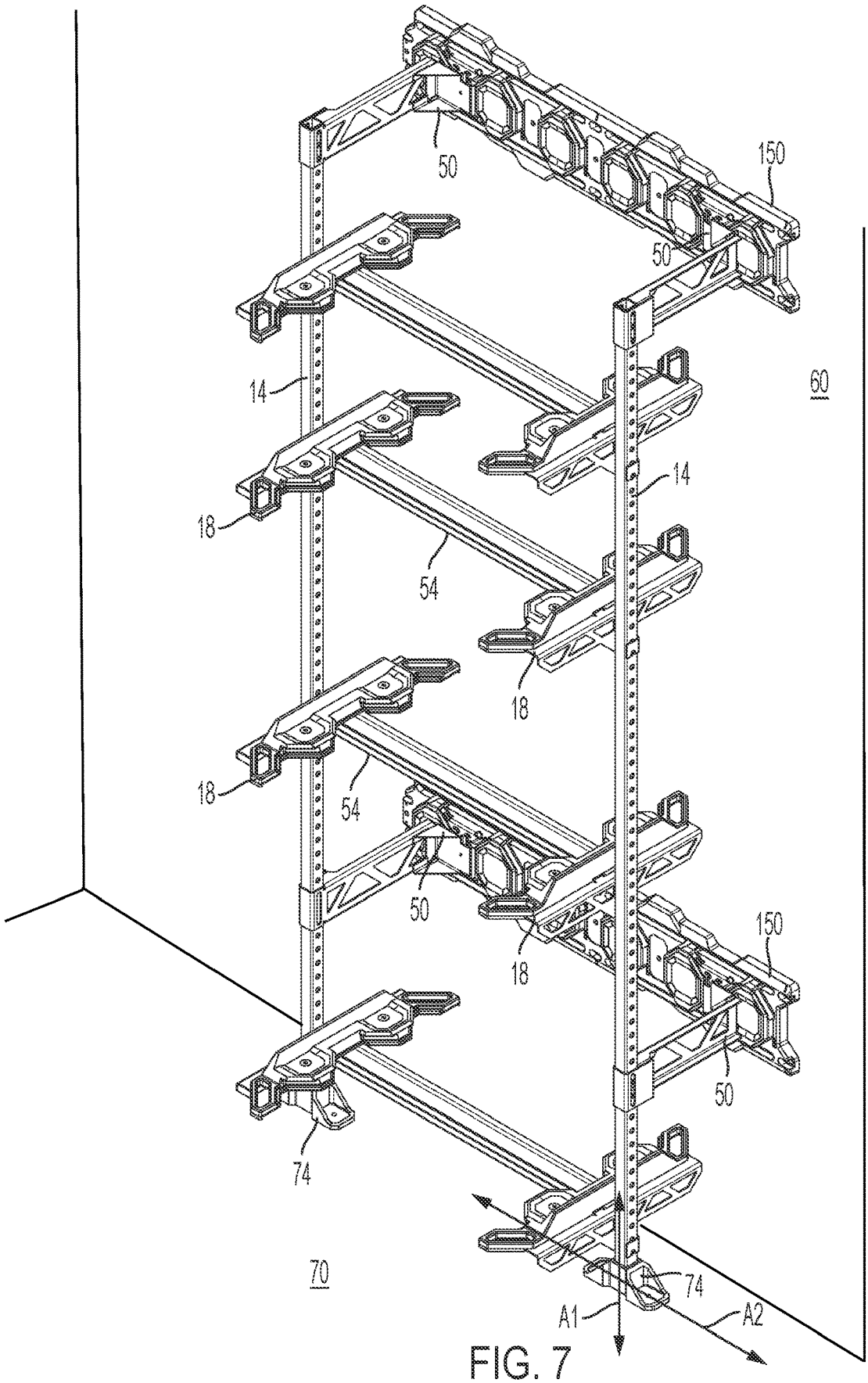
FIG. 7 is a perspective view of a storage system, according to yet another embodiment.
Figure 8:
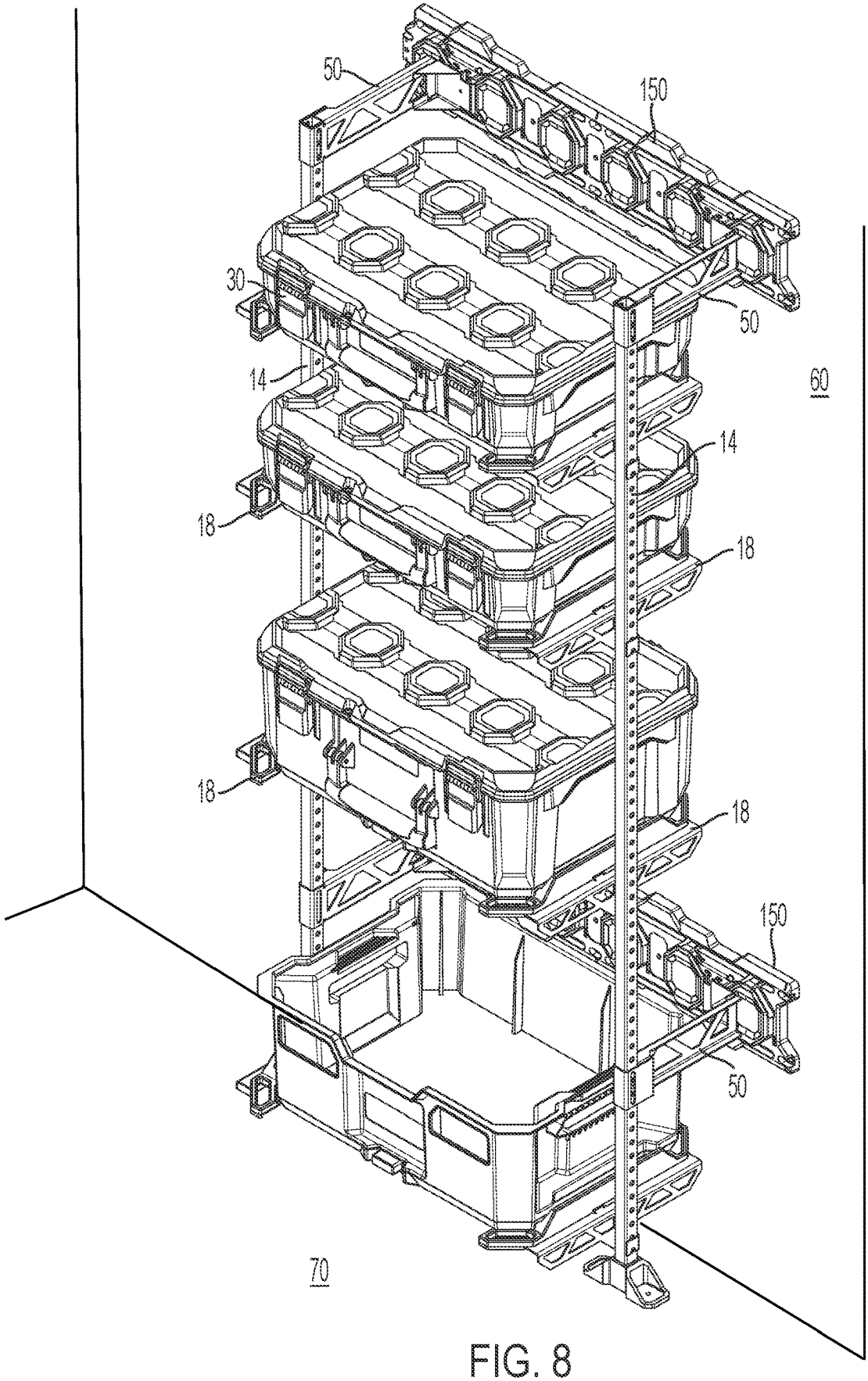
FIG. 8 is a perspective view of the storage system of FIG. 7, supporting storage containers.
Figure 9:
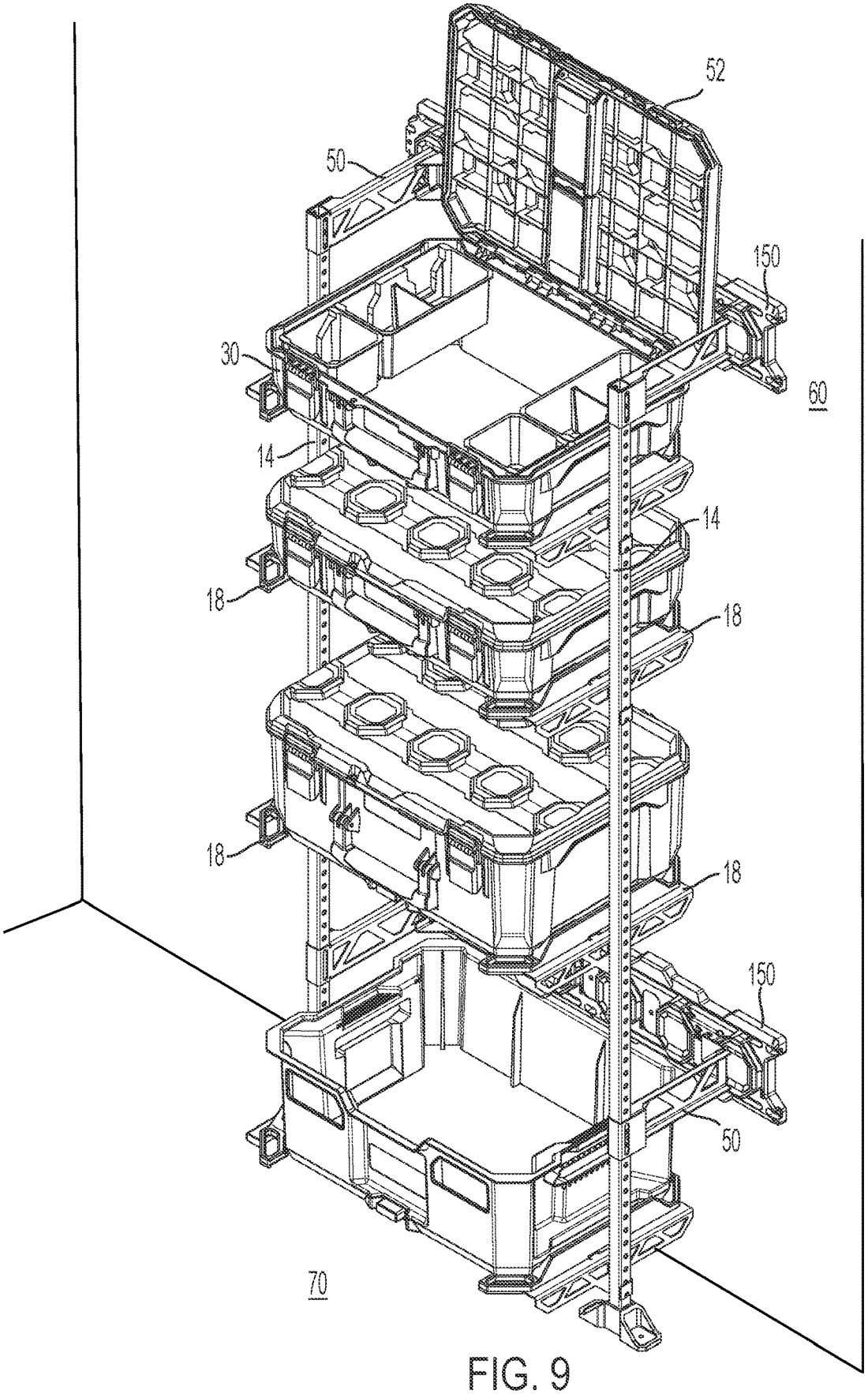
FIG. 9 is a perspective view of the storage system of FIG. 8, with a lid of a storage container in an open position.

FIGS. 6A-6C illustrate another embodiment of the storage system 10 in which the upright supports 14 can be pivoted between an extended position in which the upright supports 14 are spaced apart from a wall or wall surface 60 (e.g., a support surface), and a retracted or collapsed position in which the upright supports 14 are located adjacent the wall 60. In some embodiments, the upright supports 14 may be coupled to one or more mounting brackets 50, and pivoting joints 51 are incorporated into each mounting bracket 50 and/or upright support 14 to permit the upright support 14 to be pivoted relative to the mounting bracket 50. Also, in the illustrated embodiment, a mount or cross-member 54 may extend between the arms 18 of each pair.

In some embodiments, the pivoting joints 51 may be locked in a desired position such that the uprights supports 14 can be locked in position (e.g., the retracted position, the extended position, an intermediate position, etc.). In the illustrated embodiment, the cross-member 54 may be a cross-mount that may extend between the supports 14 to increase the strength of the system 10, in one example application. The cross-members 54 may move toward and away from the pivoting joints 51 with the upright supports 14. The cross-members 54 may each further support the storage container 30, and, in some embodiments, may contact a surface of the container 30 (e.g., bottom surface, bottom side, etc.).

FIGS. 7-10 and 13-23 illustrate another embodiment of the storage system 10 supported on the wall 60 and/or a floor surface 70. In some embodiments, each of the upright supports 14 are supported relative to a wall 60 by one or more mounting brackets 50, and each of the upright supports 14 is supported relative to the floor surface 70 by at least one foot 74. In some embodiments, the mounting brackets 50 may be secured (e.g., fastened, attached, coupled, etc.) directly to the wall 60. In other embodiments, the mounting brackets 50 may be secured to a mount or wall rail 150.

In some embodiments, the storage system 10 may be supported by both the wall 60 and the floor 70, for example, in the instance of heavier containers 30. In some embodiments, the containers 30 can hold larger objects, such as power tools, tool cases, batteries, consumable materials (e.g., dry concrete/plaster mix, epoxy, etc.), electronics, and/or the like. The mounting brackets 50, in some embodiments, may have multiple supporting arms or members. In other embodiments, any number of mounting brackets 50 may be secured to the uprights 14 in order to support larger/heavier containers 30.

Figure 10:
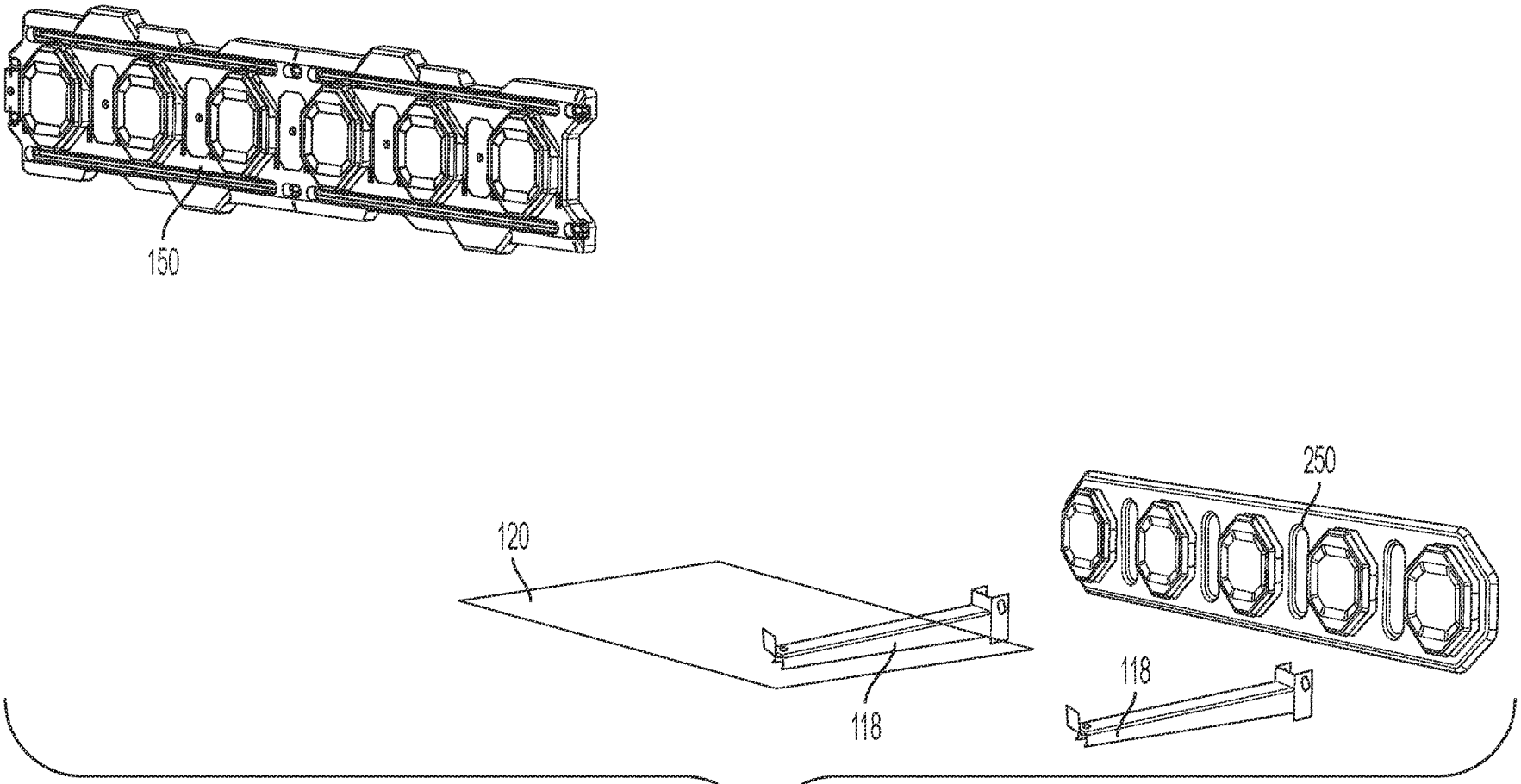
FIG. 10 is a perspective view of a wall rail system.

FIG. 10 illustrates two wall rails 150, 250 that may be configured as mounting brackets that can be alternately and/or selectively supported by the wall surface 60 or the upright supports 14. The wall rails 150, 250 may be drawn or stamped from a material such as metal. In some embodiments, the wall rails 150, 250 are molded from plastic and/or another suitable polymer. In some embodiments, the wall rails 150, 250 may engage cantilever arms 118 that support a plate 120 for engaging the storage container 30. In some embodiment, the arms 118 may be optionally supported by one or more of the pivoting joints 51. In this way, the arms 118 may be pivoted proximate to the rails 150, 250 and/or wall 60 when not in use to provide a more flexible, robust, and/or efficient design.

Figure 11:
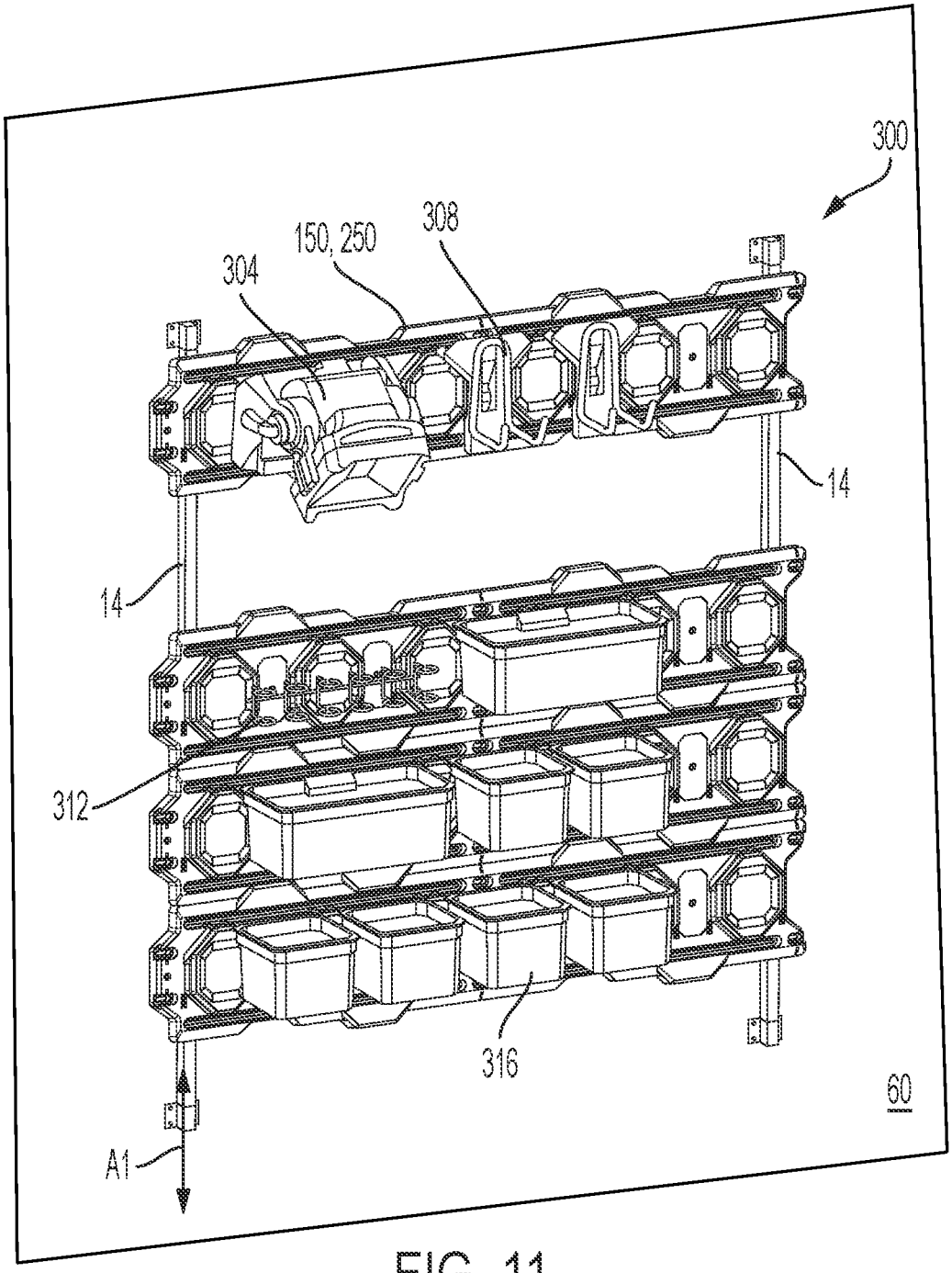
FIG. 11 is a perspective view of the wall rail system of FIG. 10 supported by upright members.
Figure 12:
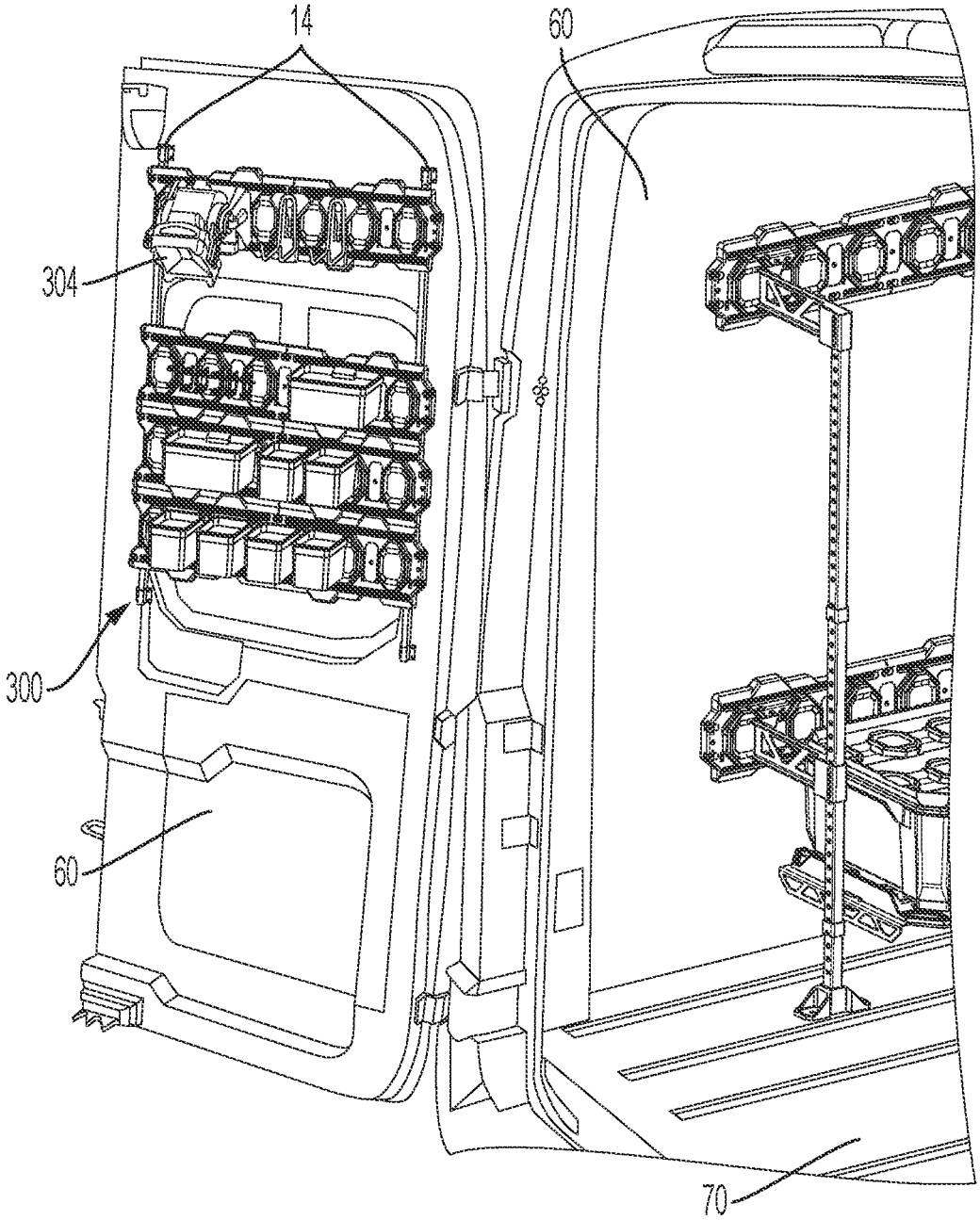
FIG. 12 is a perspective view of the wall rail system and upright members of FIG. 11, supported on a surface of a vehicle.

FIG. 11 illustrates a plurality of either of the two wall rails 150, 250 supported on at least two upright supports 14 to form a rack assembly 300. The rack 300, as illustrated in FIG. 12, is configured to interface and/or be supported on a surface, such as wall (e.g., wall surface 60) of a vehicle. For example, the rack 300 may be supported on an interior wall of the vehicle, or may be supported on an inner surface of a door of the vehicle. The rack 300 may also be supported on another type of wall 60. In the illustrated embodiment, the rack 300 may be directly attached to the wall 60. In other embodiments, the rack 300 is attached to a support (e.g., mounting bracket 50) that may be fastened to a wall surface.

The rack 300 and/or wall rails 150, 250 is/are configured to support a variety of accessories. In some embodiments, the rack 300 may support a light 304, a power tool holder 308, another type of tool holder 312, and/or a plurality of bins 316. In one example in which the rack 300 is mounted to the wall 60 of a vehicle door, the light 304 may be used to illuminate an area adjacent the wall 60 or vehicle.

Figure 13:
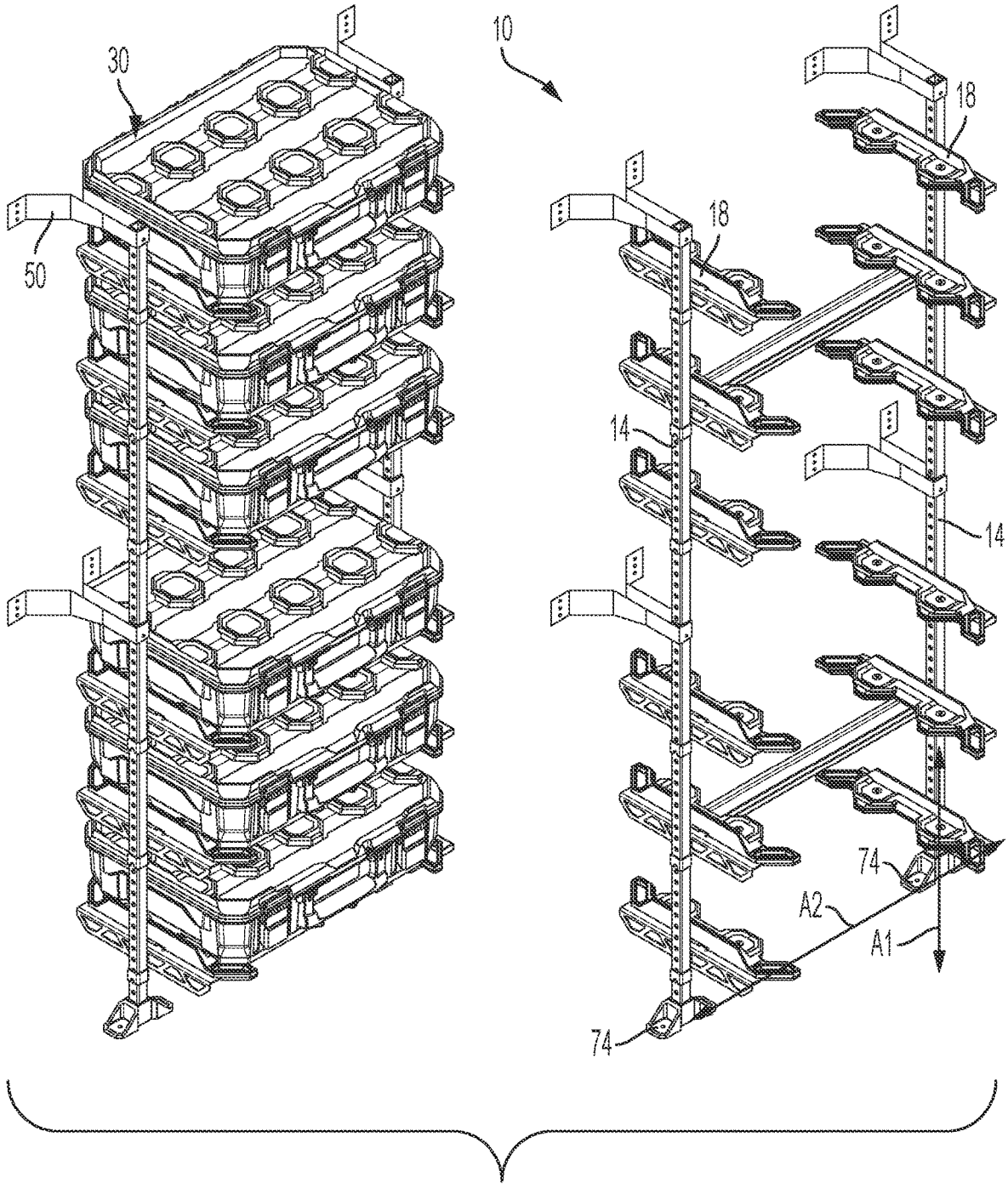
FIG. 13 is a perspective view of a storage system, according to still another embodiment.
Figure 14:
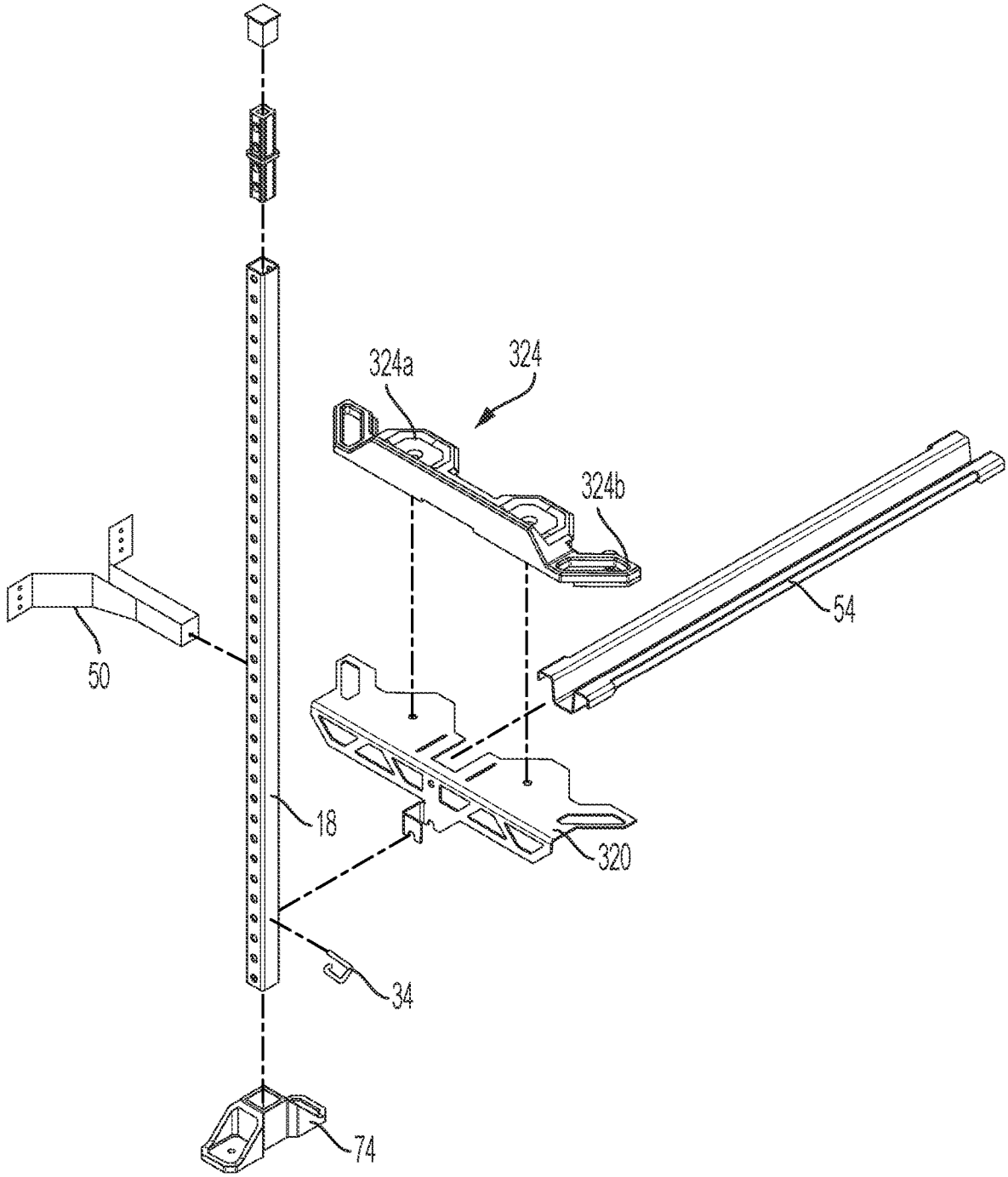
FIG. 14 is an exploded view of a portion of the storage system of FIG. 13.

FIGS. 13 and 14 illustrate an embodiment of the storage system 10 in which the arms 18 supported by the upright supports 14 include a rack support member 320 and a storage container interface 324. In one arrangement, the mount 54 may extend between the arms 18 to stabilize the storage system 10 and/or support an accessory. The container interface 324 may be shaped and sized to receive a portion of the storage containers 30 to retain the containers 30 thereon. In other words, the container interface 324 may be a mating interface or mounting interface complementary to a shape of the containers 30. In some embodiments, the rack support member 320 and a storage container interface 324 are integrally formed with the corresponding arm 18. In other embodiments, the rack support member and interface member are fastened together.

As further illustrated in FIG. 14, the rack support member 320 may support a portion of the interface 324. The interface may include one or more cleat features 324*a* and may have one or more wings 324*b*. The cleat features 324*a* may engage one or more gaps 862, as described in greater detail below. The wings 324*b* may correspond to an outer perimeter or periphery of the containers (e.g., container 30) to smoothly and/or snugly receive the container 30. In some embodiments, the perimeter of the containers 30 may be similar to the size and shape of the rack support member 320 and/or arms 18 to complement one another.

Figure 15:
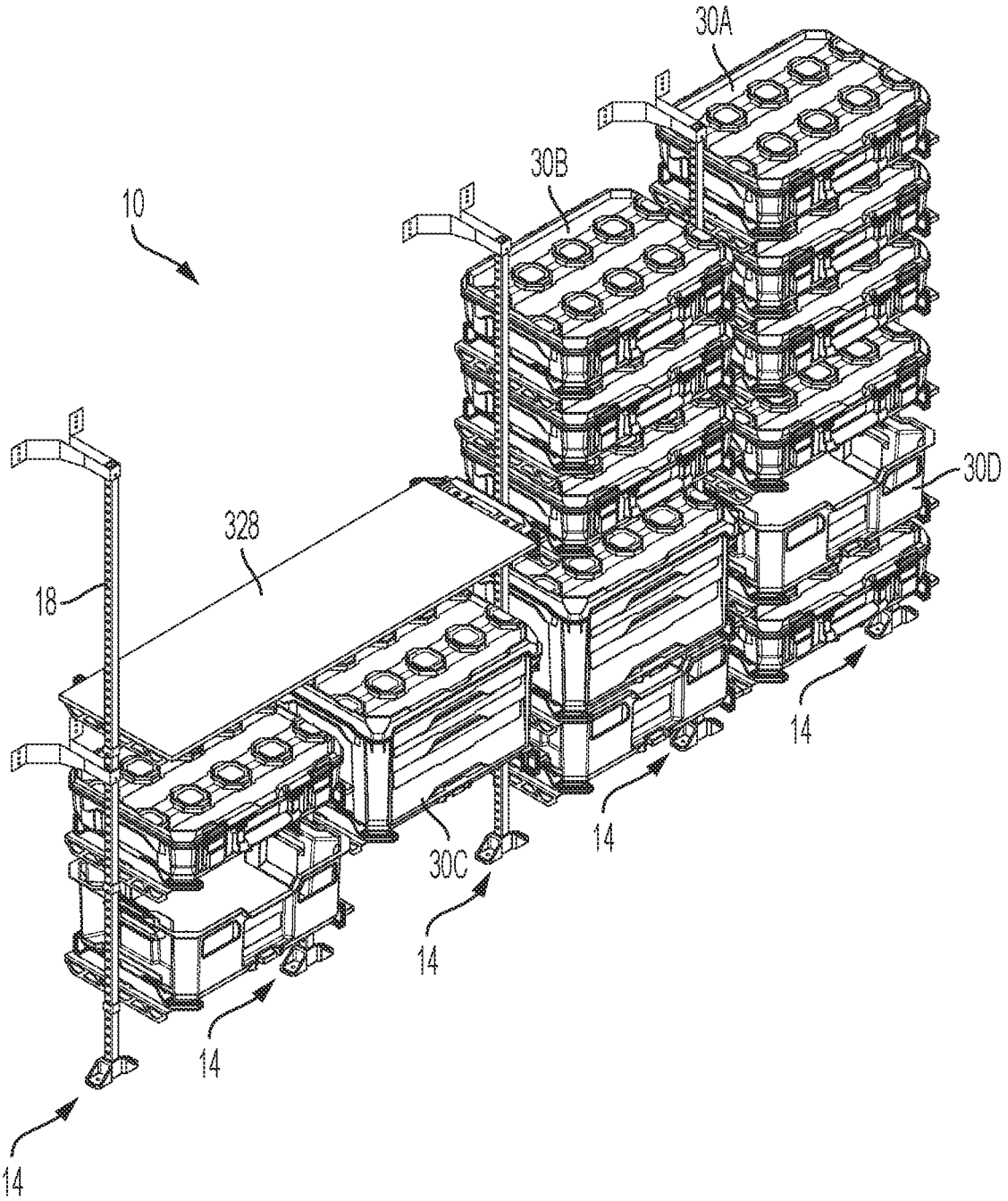
FIG. 15 is a perspective view of the storage system of FIG. 13 in one exemplary configuration.

FIG. 15 illustrates an example configuration of the storage system 10 in which a variety of containers 30 are each supported in the common storage system 10, and in which supports 14 are connectable in a row or series. For example, FIG. 15 illustrates a standard case 30A, an organizer case 30B, a drawer case 30C, and an open topped crate case 30D supported between the same upright supports 14. FIG. 15 also illustrates upright supports 14 of different heights, which are configurable to multiple desired heights. FIG. 15 further illustrates an arrangement of the storage system 10 in which the arms 18 are configured and arranged to support a working surface 328 such as a panel, a container cover, a piece of wood, shelving, a tabletop, and/or the like. In the illustrated embodiment, the standard case 30A and the organizer case 30B have an openable lid, such as the lid 52 illustrated in FIG. 9 in an open position.

Figure 16:
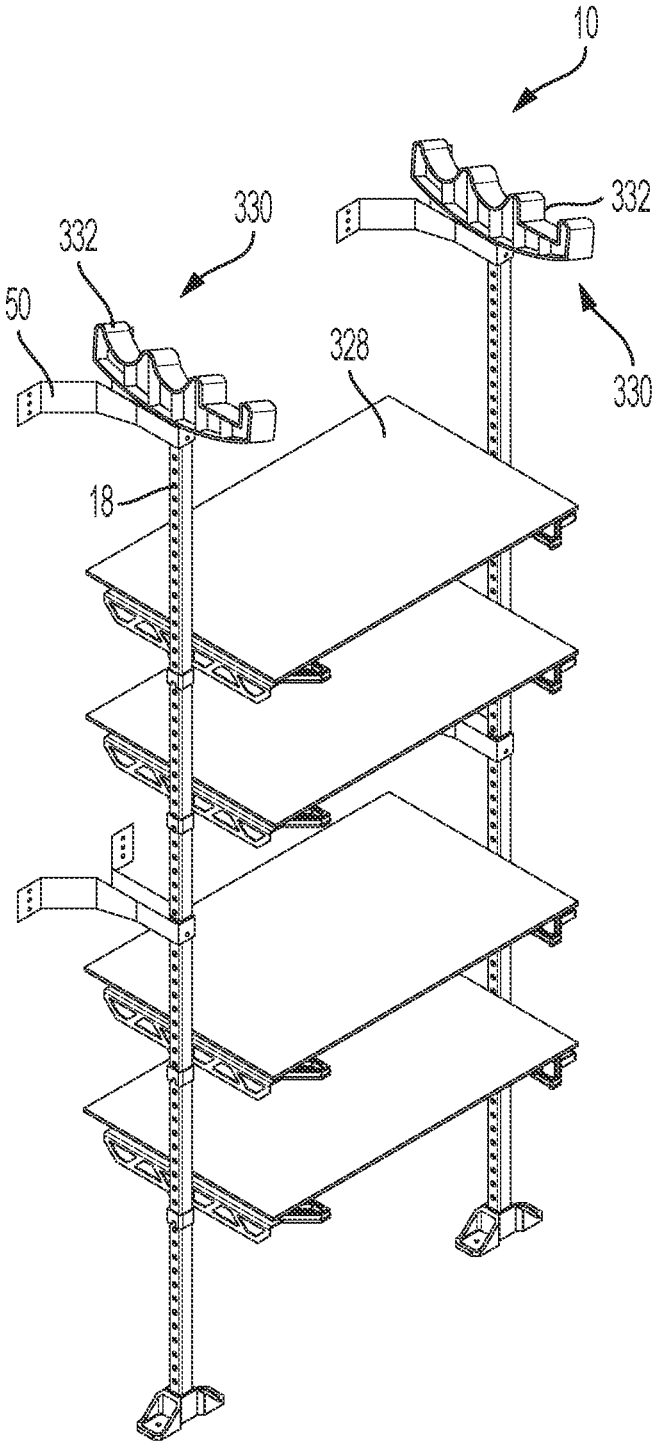
FIG. 16 is a perspective view of a storage system, according to another embodiment.
Figure 17:
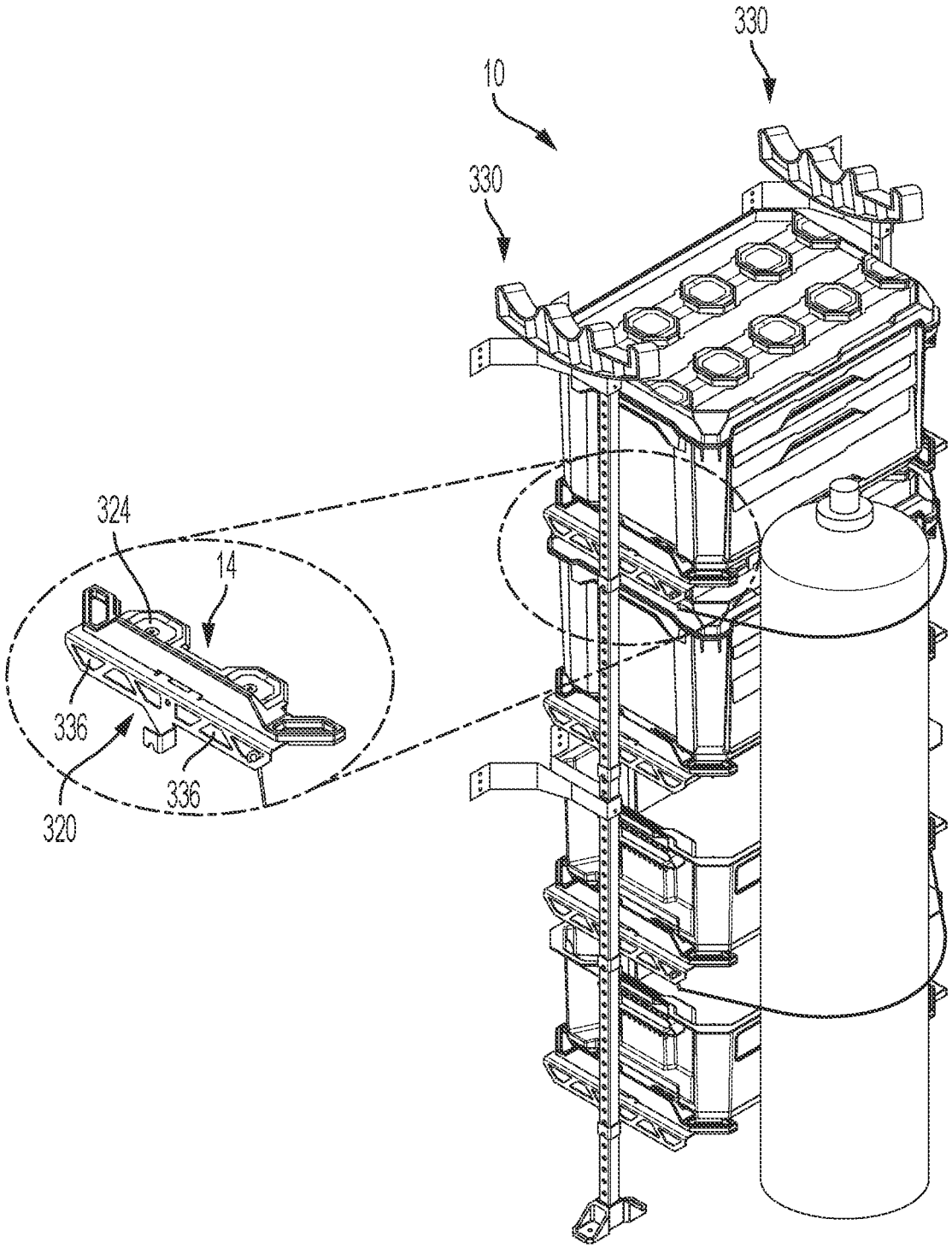
FIG. 17 is a perspective view of the storage system of FIG. 16 in one exemplary configuration.
Figure 18:
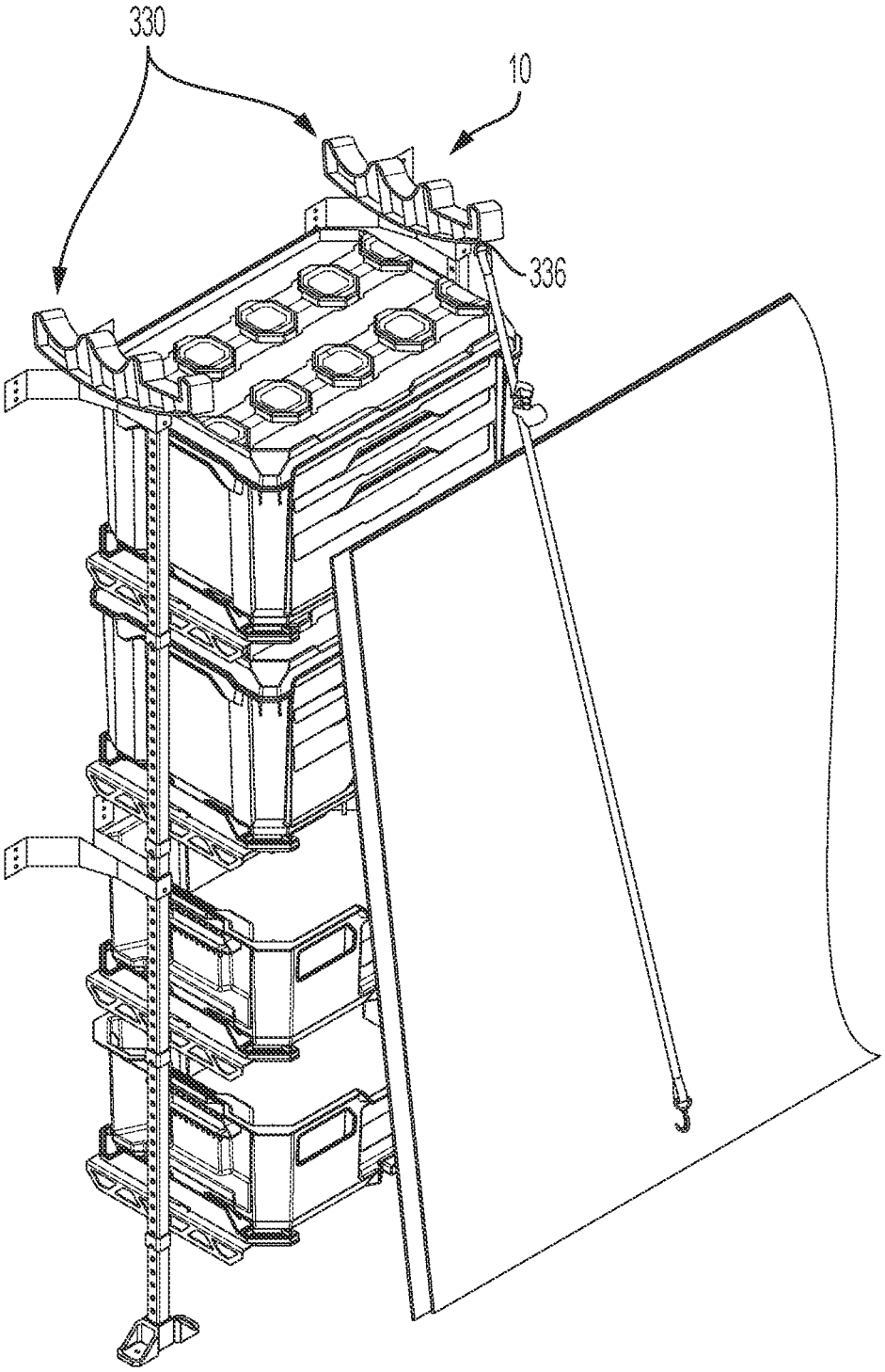
FIG. 18 is a perspective view of the storage system of FIG. 17, supporting another exemplary configuration.

FIG. 16 illustrates another example embodiment of the storage system 10 in which an upper terminating end of each support 14 defines and/or supports a rack 330, and each of the supports 14 braces one or more of the arms 18, rack support members 320, etc. The rack 330 may have open grooves or channels 332. As illustrated in FIGS. 17 and 18, the rack support members 320 may include apertures 336 configured as anchoring points for receiving a bungee cord, ratchet strap, hooking member, and/or the like. In one example (FIG. 17), a bungee cord may be attached around an item (e.g., propane tank) and secured in the apertures 336 on opposing supports 14. In another example (FIG. 18), a ratchet strap may be attached to an aperture 336 and secured to a mount on another part of the storage system 10, or secure to a mount independent of the storage system.

Figure 19:
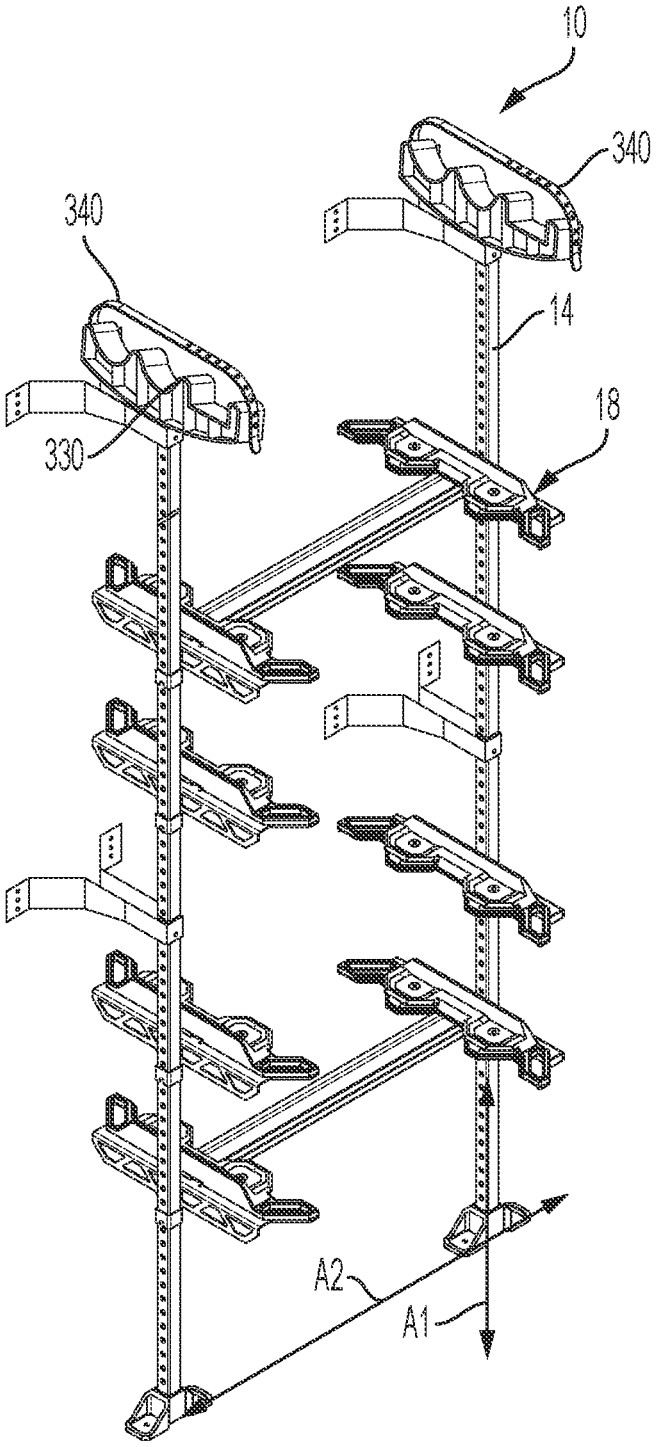
FIG. 19 is a perspective view of a storage system, according to yet another embodiment.
Figure 20:
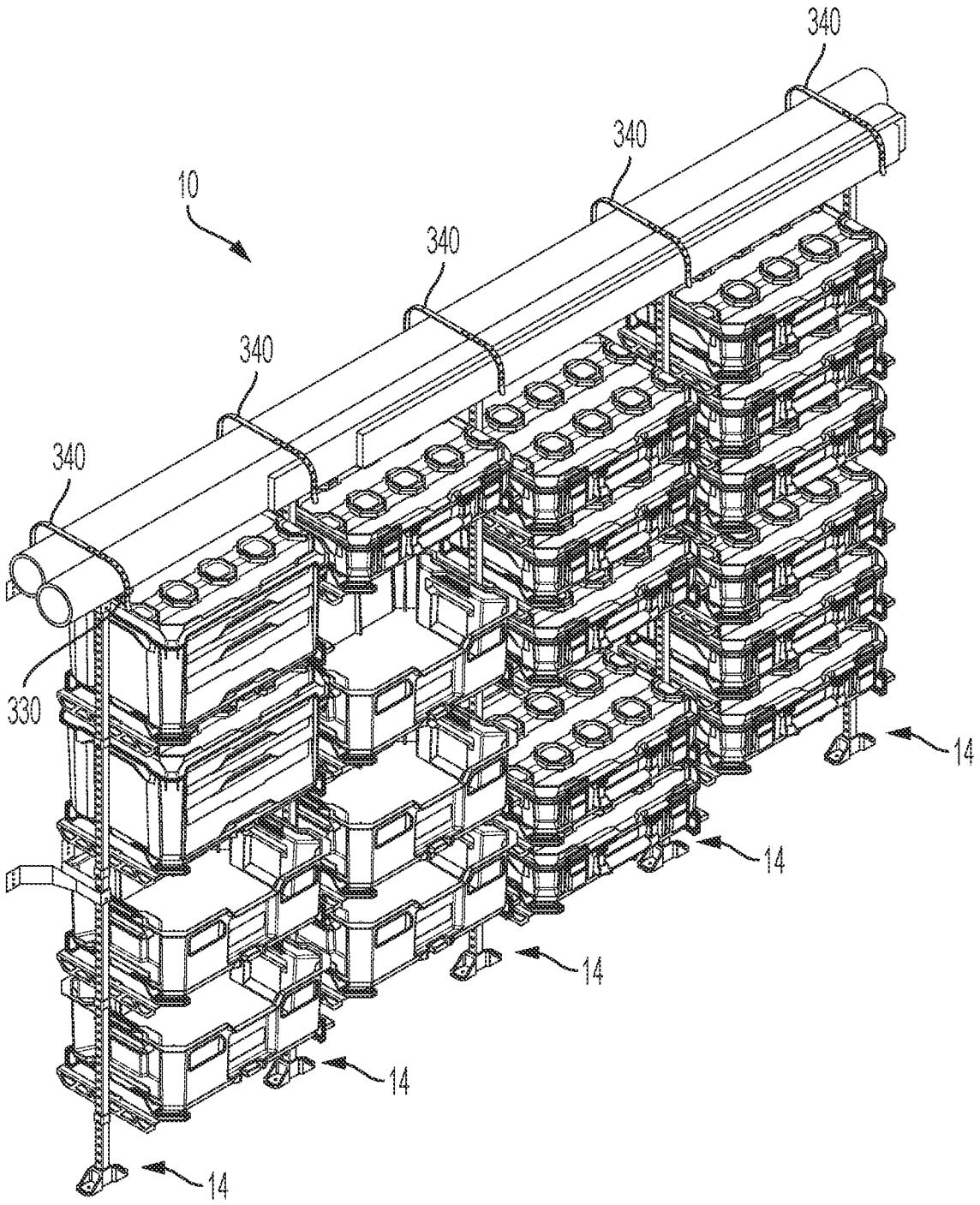
FIG. 20 is a perspective view of the storage system of FIG. 19 in one exemplary configuration.

FIGS. 19 and 20 illustrate another embodiment of the storage system 10 including a strap 340. As shown in FIG. 19, the strap 340 may be permanently attached to one end of the rack 330 and selectively attached (e.g., attached by a user) to an opposing end of the rack 330. In other embodiments, the strap 340 is removably coupled to the rack 330 at both ends. The strap 340 is configured to be passed around an item (e.g., boards, pipes, poles, handles of a tool, etc.) and secured to the rack 330 to retain the item(s) on the rack 330. The strap 340 may be a rigid material, an elastic strap, a tether, a rope, a chain, a linkage, or the like.

FIG. 20 illustrates one exemplary configuration of the storage system 10 in which multiple upright supports 14 are arranged in a row to form (e.g., support) a series of containers 30. In such arrangement, the rack 330 may be configured to support elongated items (e.g., tubing, PVC pipe, framing boards, logs, etc.) that may not ordinarily be supported by a single pair of upright supports 14. The strap 340 may be selectively attached to the rack 330 to secure the elongated items on top of the upright supports 14.

Figure 21:
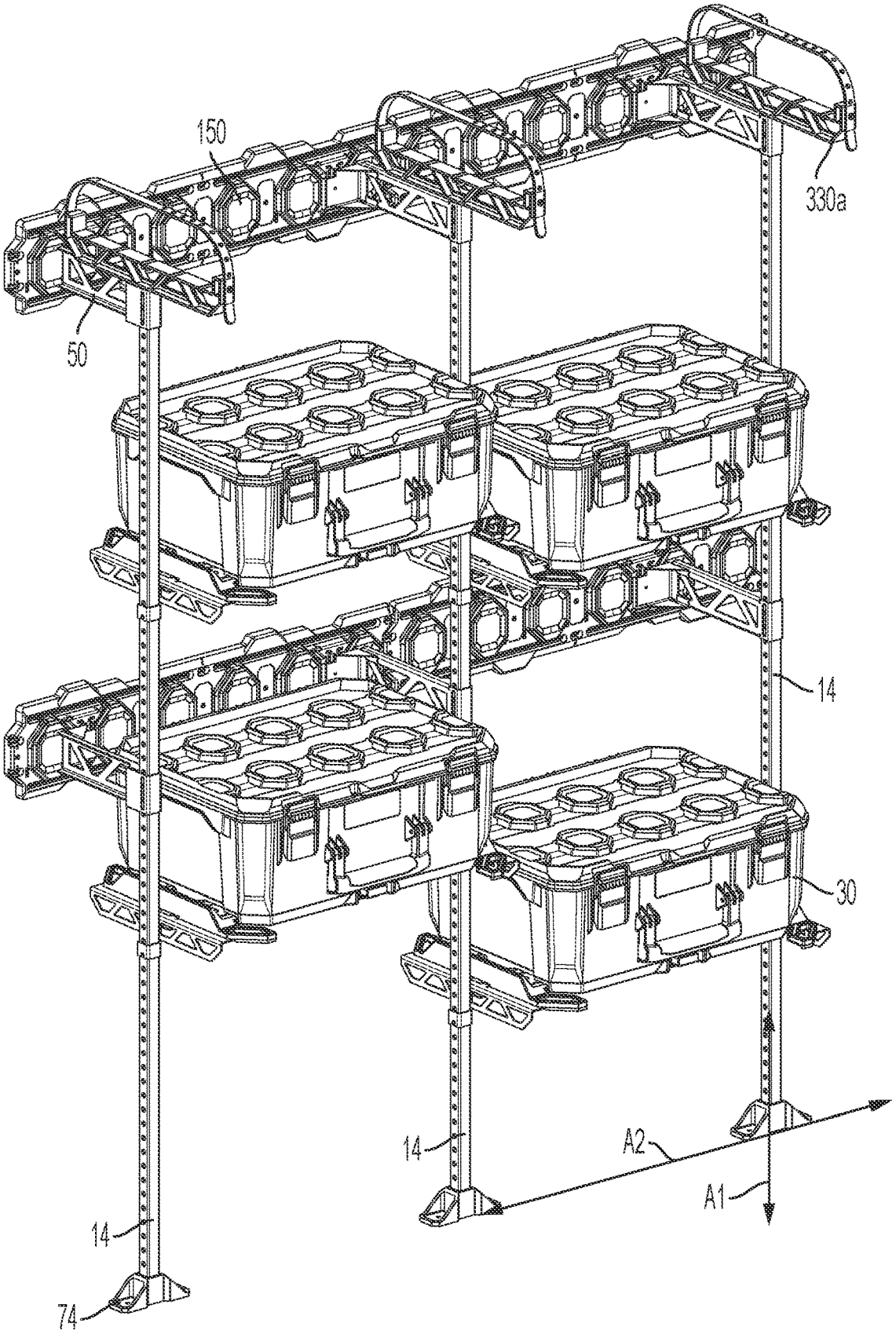
FIG. 21 is a perspective view of the storage system of FIG. 7 in one exemplary configuration.

FIG. 21 illustrates one exemplary configuration of the storage system 10 in which multiple upright supports 14 are arranged in a row to form a series of containers 30. In the illustrated configuration, the containers 30 may be offset relative to one another in a vertical direction such that the containers 30 are supported at various heights. Further, the multiple upright supports 14 may be supported on the wall 60 (e.g., a surface of the wall) by the mounting brackets 50 and either of the wall rails 150, 250 and/or on a floor surface by the feet 74. In other words, the mounting brackets 50 and the feet 74 may be surface mounting supports or brackets.

Figure 22:
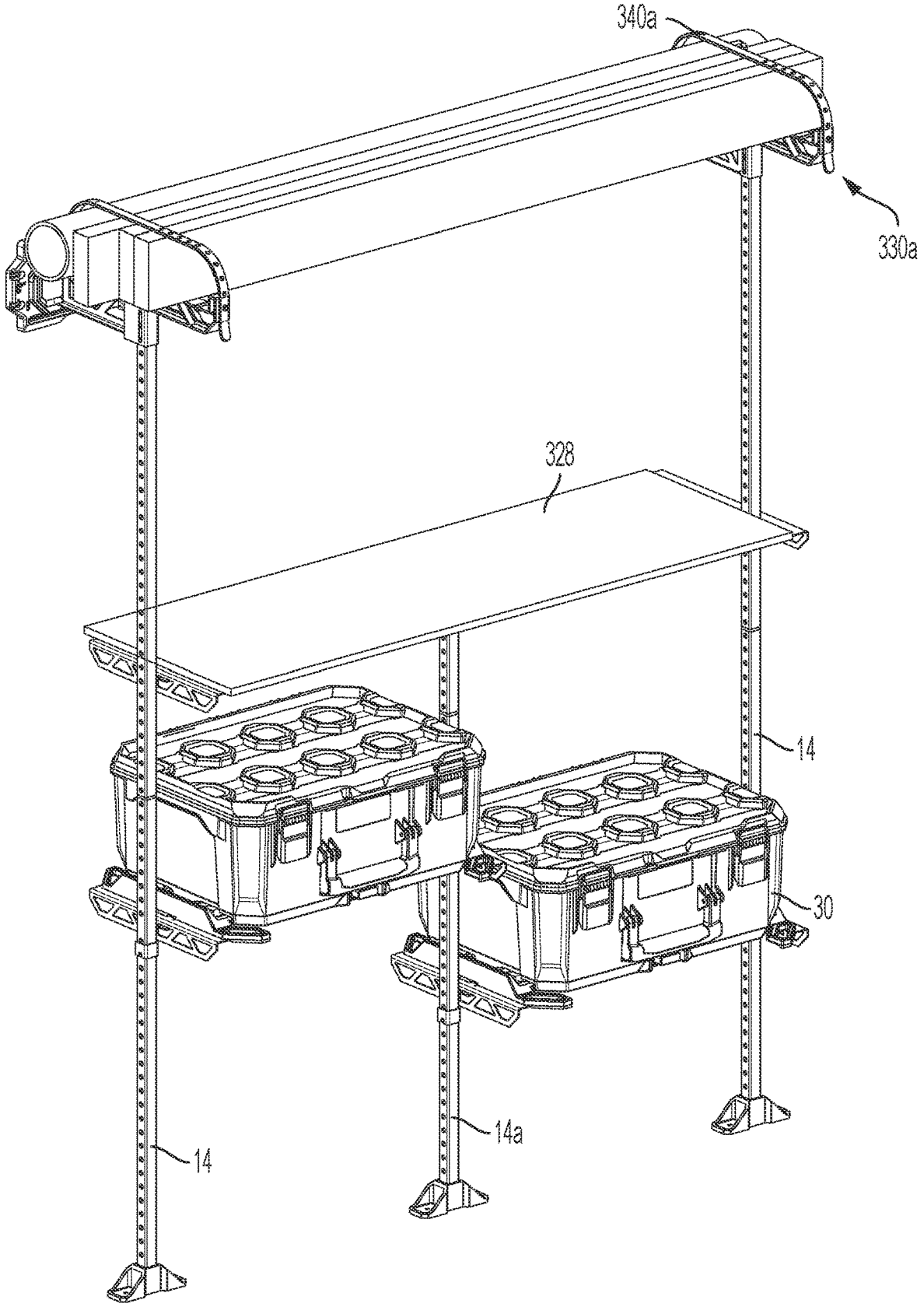
FIG. 22 is a perspective view of the storage system of FIG. 7 in another exemplary configuration.
Figure 23:
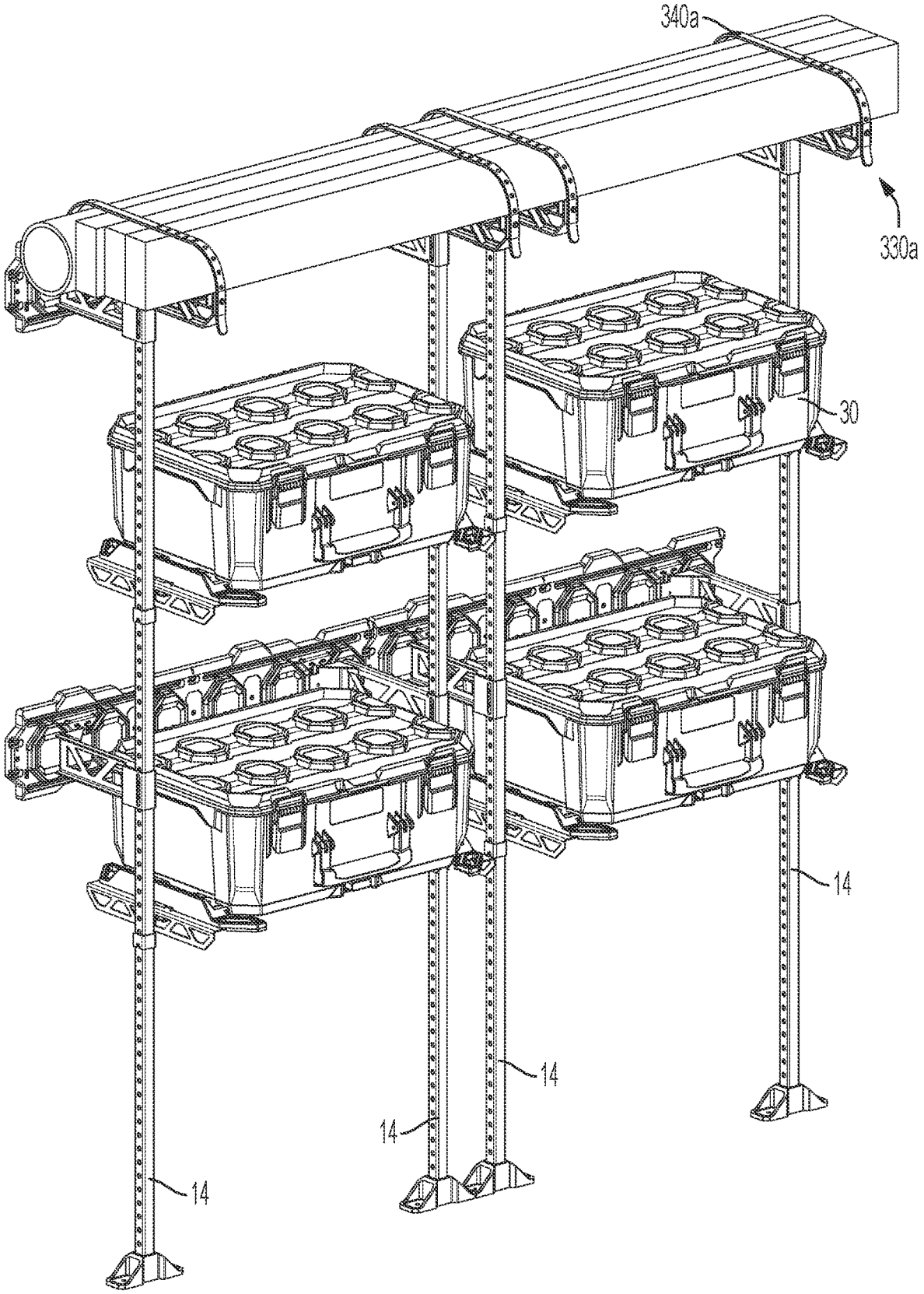
FIG. 23 is a perspective view of the storage system of FIG. 7 in still another exemplary configuration.

FIG. 22 illustrates one exemplary configuration of the storage system 10 in which multiple upright supports 14 are arranged in a row to form a series of containers 30. In the illustrated configuration, the storage system 10 includes a rack 330*a* substantially similar to the rack 330. As illustrated in FIG. 22, the rack 330*a* may be configured to support elongated items (e.g., tubing, PVC pipe, framing boards, logs, etc.) between two spaced apart or separated upright supports 14 having a less than full-length (e.g., half-length support 14*a*) support 14 positioned therebetween. The working surface 328 may be supported by the half-length support 14*a*. A strap 340*a* similar to the strap 340 can be selectively attached to the rack 330*a* to secure the elongated items on top of the upright supports 14. In the example configuration of the storage system 10 illustrated in FIG. 23, the half-length support 14*a* may be replaced by two full-length upright support 14 and the working surface 328 (not shown) may be omitted. In other embodiments, the half-length support 14*a* may be replaced by a single full-length upright support 14.

In one example, the storage system 10 may be secured to a wall 60 to store containers 30 and said elongated items in a room, warehouse, or the like. In another example, the storage system 10 may be secured to a wall 60 in a vehicle to store containers 30 and such elongated items in the vehicle, and the straps 340 may be used to prevent any items supported on the rack 330 from shifting or falling during transport. In yet another example, the storage system 10 may be supported independently from the wall 60 and mounting brackets 50 (e.g., may be free standing).

In some embodiments, portions of the storage system 10, such as the interface 324 and/or the rails 150, 250, are sized and shaped to mate with a stacking interface of a storage container. An example of a stacking interface is described at least in U.S. Publication Ser. No. 17/153,251, filed Jan. 20, 2021, the contents of which are incorporated by reference herein.

Figure 24:
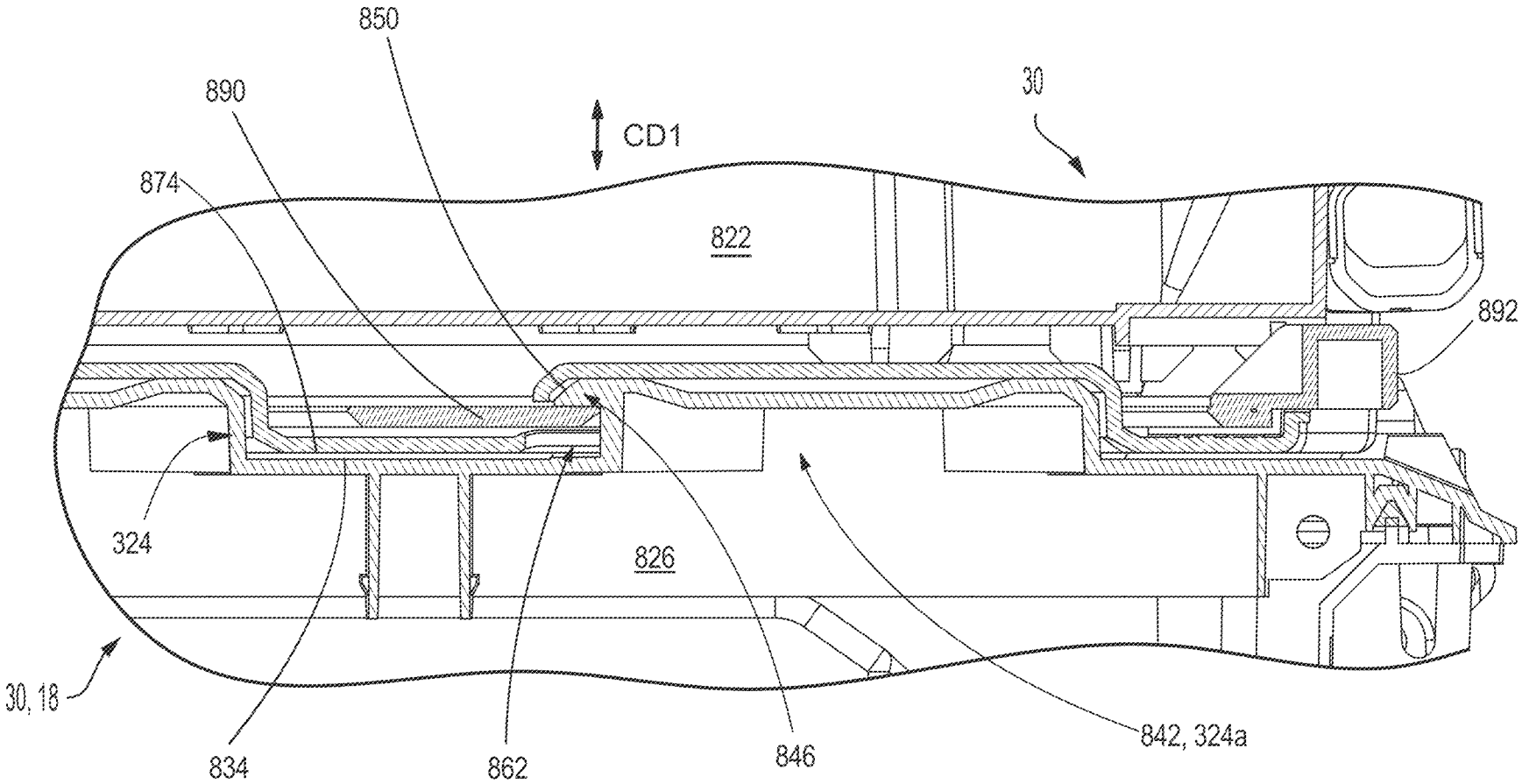
FIG. 24 is a cross-sectional view of the storage system with a latching mechanism of an upper storage container in an engaged position with a lower storage container, illustrating an example mating interface between a container and a container support.
Figure 25:
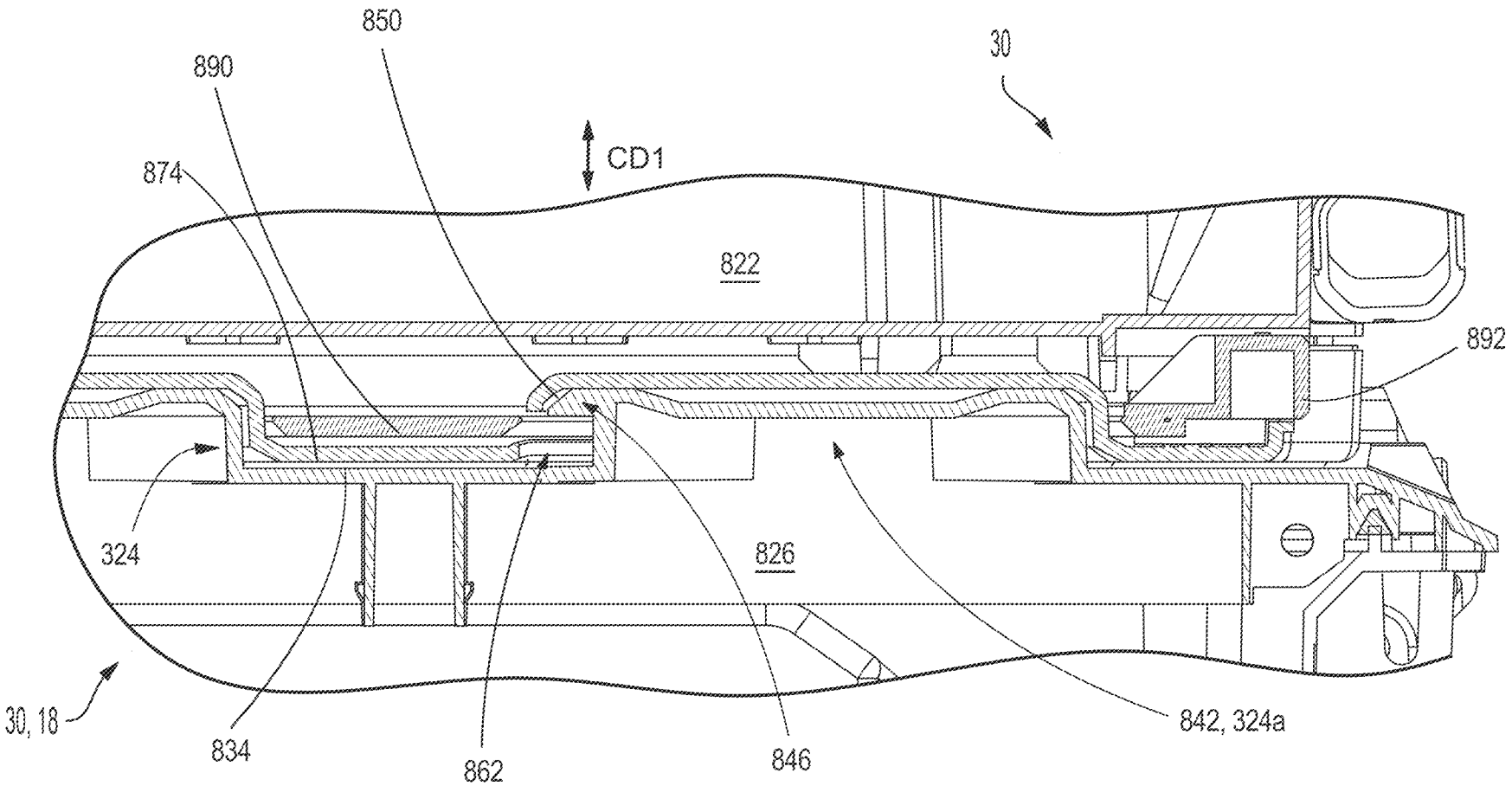
FIG. 25 is a cross-sectional view of the storage system with a latching mechanism of an upper storage container in a disengaged position with a lower storage container, illustrating an example mating interface between a container and a container support.

Referring now to FIGS. 24 and 25 the mating interface 324 is configured to secure a base 822 of one container (e.g., the container 30) to a lid 826 of an underlying container (e.g., the container 30) or to the rack support member 320, arm 18, or the like. The mating interface 324 is movable between an engaged position (i.e., a "first position", FIG. 25) in which the containers 30 are removably coupled to each other or to the storage system 10 and a disengaged position (i.e., a "second position," FIG. 25) in which the containers 30 are movable relative to each other or moveable relative the arm 18.

FIGS. 24 and 25 illustrate that the base 822 of the container 30 is provided with a ramped feature or surface 850, and the lid 826 includes a flange feature or tab 846. The flange or tab 846 may also be formed and/or included on the rack support member 320 and/or arm 18 such that the feature 850 and feature 846 may make a portion of the mating interface 324 between the container 30 and the system 30. The tab 846 may be provided on a cleat of the container 30.

The mating interface 324 may include a locking member 890 which is movable. In some embodiments, the locking member 890 may be biased towards the engaged position. In another embodiments, the locking member 890 may be otherwise arranged between the containers 30.

During a stacking operation of adjacent containers 30 or during a dropping/pressing operation of a container 30 onto an arm 18, one container (e.g., the container 30) may be placed on top of another container (e.g., the container 30) of the arm 18 such that the adjacent containers 30 of adjacent container 30 and arm 18 engage one another at the mating interface 324 and are commonly oriented. A force exerted along a coupling direction CD1 (e.g., by the user, or due to the weight of the upper container 30, and/or both) may cause the ramped surfaces 850 of projections 842 to align the base 822 on the lid 826/arm 18 with the ramped surface 850 positioned adjacent the tab 846. The force along the coupling direction CD1 may also move the locking member 890 against the biasing force toward the second position (FIG. 25). Once the adjacent containers 30/containers 30 and arm 18 are brought close enough together for the locking member 890 to move past the tab 846 and inclined surface 850, the locking member 890 is urged to at least partially extend into a gap 862 located between the ramped surface 850 and a surface 834 (i.e., to a "first position", FIG. 24). In this position, the locking plate 890 is retained between the tab 846 and the surface 834, and the locking plate 890 inhibits movement of the base 822 relative to the lid 826 or arm 18 in a direction at least partially parallel to the coupling direction CD1. Additionally, in this position, the locking plate 890 engages portions of both containers 30/both the container 30 and the arm 18 thereby locking them together.

During a separating operation of adjacent containers 30/adjacent containers 30 and arm 18, the user actuates a button 892. The button 892 may be integrally formed with the locking plate 890 such that translation of the button 892 (from the first position in FIG. 24 to the second position of FIG. 25) causes corresponding translation of the locking plate 890. In the illustrated embodiment, the button 892 may be translated in a direction generally perpendicular to the coupling direction D1. Other actuation directions may be possible. In some embodiments, the button 892 is positioned to enable the locking member 890 to be moved by the same hand that grasps a handle of the container 30. Once the storage containers 30 are released from one another or from the arm 18, the may be separated along the coupling direction CD1 (e.g., by lifting an upper container away from a lower container or from an arm). After the containers 30 have been separated, the locking member 890 may move to the first position by way of the biasing force. Other similar mating interfaces 324 may interconnect the container 30 to the container 30 or to the arm 18. In some embodiments, the locking member 890 may provide tactile feedback and ramped features may be provide on both sides of the locking member such that locked containers 30 may be moved by a lifting force great enough to overcome a biasing force of a biasing member.

Although aspects of the disclosure have been described in detail with reference to certain preferred embodiments, variations and modifications exist within the scope and spirit of one or more independent aspects as described.

What is claimed is:

1. A storage system comprising:

a first upright member configured to be supported relative to a surface;

a second upright member configured to be supported relative to the surface, the second upright member oriented parallel to the first upright member;

a third upright member oriented parallel to and positioned between the first upright member and the second upright member;

a first mount selectively supported by one of the first upright member and the second upright member, the first mount configured to support an accessory, the first mount having at least two mounting interfaces positioned between the first upright member and the second upright member, wherein each mounting interface is complementary to a feature positioned on the accessory, each mounting interface comprising a tab forming a gap between the tab and a surface of the first mount;

a second mount selectively coupled to the third upright member in a first orientation in which the second mount faces toward the first upright member and a second orientation in which the second mount faces toward the second upright member; and a third mount selectively supported by the other of the first upright member and the second upright member and oriented parallel to the first mount, the first mount and the third mount supporting a work surface extending between the first upright member and the second upright member.

2. The storage system of claim 1, wherein a height of the third upright member is less than a height of the first upright member and a height of the second upright member.

3. The storage system of claim 1, wherein the first upright member and the second upright member are configured to be supported by a horizontal floor surface.

4. The storage system of claim 1, wherein the first upright member and the second upright member are configured to be supported by a vertical wall surface.

5. The storage system of claim 1, wherein the mount is supported on the first upright member at an intermediate position of the mount located between a forward end and a rear end of the mount.

6. The storage system of claim 1, further comprising a rack supported by at least one of the upright members.

7. The storage system of claim 1, further comprising a first rack coupled to an upper end of the first upright member and a second rack coupled to an upper end of the second upright member, the first rack and the second rack oriented parallel to one another and configured to support a workpiece extending between the first rack and the second rack.

* * * * *